US009751689B2

(12) United States Patent
DiNovo et al.

(10) Patent No.: US 9,751,689 B2
(45) Date of Patent: Sep. 5, 2017

(54) PRESSURE VESSEL SYSTEM AND METHOD

(71) Applicant: Pentair Residential Filtration, LLC, Glendale, WI (US)

(72) Inventors: Ignatius L. DiNovo, Mentor, OH (US); James Lorenz, Madison, OH (US); Nick Herald, Richmond Heights, OH (US); James Craven, Newbury, OH (US); Kenneth Baraw, Mentor, OH (US)

(73) Assignee: Pentair Residential Filtration, LLC, Glendale, WI (US)

( * ) Notice: Subject to any disclaimer, the term of this patent is extended or adjusted under 35 U.S.C. 154(b) by 177 days.

(21) Appl. No.: 14/495,780

(22) Filed: Sep. 24, 2014

(65) Prior Publication Data

US 2015/0083234 A1 Mar. 26, 2015

Related U.S. Application Data

(60) Provisional application No. 61/881,877, filed on Sep. 24, 2013, provisional application No. 61/926,862, filed on Jan. 13, 2014.

(51) Int. Cl.

| | |
|---|---|
| ***F17C 1/06*** | (2006.01) |
| ***B65D 90/04*** | (2006.01) |
| ***B65D 90/22*** | (2006.01) |

(52) U.S. Cl.

CPC ..... *B65D 90/041* (2013.01); *B65D 90/22* (2013.01); *Y10T 137/3115* (2015.04); (Continued)

(58) Field of Classification Search

CPC .... B65D 90/04; B65D 90/041; B65D 90/044; B65D 90/046; B65D 90/22

(Continued)

(56) References Cited

U.S. PATENT DOCUMENTS 2,300,722 A 11/1942 Adams et al.
2,340,125 A 1/1944 Huebner, Jr. et al.

(Continued)

FOREIGN PATENT DOCUMENTS

GB 2028924 A 3/1980

OTHER PUBLICATIONS

International Search Report and Written Opinion of the International Searching Authority issued in PCT application No. PCT/US14/57290, mailed Dec. 17, 2014, 11 pages.

*Primary Examiner* — Steven A. Reynolds
*Assistant Examiner* — Javier A Pagan
(74) *Attorney, Agent, or Firm* — Quarles & Brady LLP

(57) ABSTRACT

Diaphragm joint and convolutions, bottom screen diffuser, air stem, cap, and diaphragm restrictor systems for a pressure vessel are disclosed. A convoluted diaphragm divides the vessel into a pair of sealed chambers. The convoluted geometry of the diaphragm minimizes stress on the diaphragm at maximum displacement conditions. An H-ring, with or without being over-molded by the convoluted diaphragm, may be configured to receive end portions of the tank liners. A bottom diffuser, coupled to an inlet of the vessel, diffuses and mixes water flowing into and out of the vessel and drains water out of the vessel. Fiberglass windings surround and lock the tank liners in tension. The cap system includes a valve cap that engages an air stem. An outer cap covers a recess of the vessel and includes a hollow cavity that receives the valve cap. A diaphragm restrictor limits upward movement of the diaphragm within the vessel.

10 Claims, 14 Drawing Sheets

(52) U.S. Cl.
CPC .. *Y10T 137/7062* (2015.04); *Y10T 137/85938* (2015.04); *Y10T 137/86236* (2015.04)

(58) Field of Classification Search
USPC ..... 220/562, 563, 564, 565, 567.3, 567.2, 220/581, 582, 584, 586, 588, 221, 304, 220/795, 310.1, 378, 614, 681
See application file for complete search history.

(56) References Cited

U.S. PATENT DOCUMENTS

| | | | | |
|---|---|---|---|---|
| 2,371,632 | A * | 3/1945 | Lippincott | F15B 1/125 114/74 T |
| 2,394,401 | A | 2/1946 | Overbeke | |
| 3,346,014 | A | 10/1967 | Candido | |
| 3,623,512 | A | 11/1971 | Ellwanger et al. | |
| 3,654,964 | A | 4/1972 | Mercier et al. | |
| 3,674,054 | A | 7/1972 | Mercier | |
| 3,788,627 | A | 1/1974 | Wieland | |
| 3,802,464 | A | 4/1974 | Frank et al. | |
| 3,836,117 | A | 9/1974 | Panicali | |
| 3,931,834 | A | 1/1976 | Caillet | |
| 4,117,866 | A | 10/1978 | Bohm et al. | |
| 4,164,639 | A | 8/1979 | Zahid | |
| 4,315,527 | A | 2/1982 | Donnenberg et al. | |
| 4,335,751 | A | 6/1982 | Sugimura et al. | |
| 4,474,215 | A | 10/1984 | Richter et al. | |
| 4,595,037 | A | 6/1986 | LeBreton et al. | |
| 4,610,369 | A | 9/1986 | Mercier | |
| 4,777,983 | A | 10/1988 | Steveley | |
| 4,784,181 | A | 11/1988 | Hilverdink | |
| 5,027,860 | A * | 7/1991 | Tuthill, Jr. | B65D 88/62 138/26 |
| 5,117,873 | A | 6/1992 | Miyakawa et al. | |
| 5,176,178 | A | 1/1993 | Schurter et al. | |
| 5,368,073 | A | 11/1994 | Murphy | |
| 5,383,566 | A | 1/1995 | Johnson | |
| 5,386,925 | A | 2/1995 | Lane | |
| 5,427,152 | A | 6/1995 | Weber | |
| 5,606,996 | A | 3/1997 | Sugimura | |
| 5,778,679 | A | 7/1998 | Celorier, Jr. et al. | |
| 5,992,832 | A | 11/1999 | Lamorlette et al. | |
| 6,016,841 | A | 1/2000 | Larsen | |
| 6,041,820 | A | 3/2000 | Boehme | |
| 6,092,552 | A | 7/2000 | Takamatsu et al. | |
| 6,129,236 | A | 10/2000 | Osokin et al. | |
| 6,199,717 | B1 | 3/2001 | Tsai | |
| 6,264,247 | B1 | 7/2001 | Lombari | |
| 6,312,608 | B1 | 11/2001 | Buckner | |
| 6,401,966 | B2 | 6/2002 | Tsai | |
| 6,871,671 | B2 | 3/2005 | Weber | |
| 6,901,965 | B2 | 6/2005 | Baltes et al. | |
| 6,994,228 | B2 | 2/2006 | Yoshihara et al. | |
| 7,013,924 | B1 | 3/2006 | Meyers et al. | |
| 7,108,015 | B2 | 9/2006 | Lombari et al. | |
| 7,108,016 | B2 | 9/2006 | Moskalik et al. | |
| 7,216,673 | B2 * | 5/2007 | Gremour | F24D 3/1016 138/26 |
| 7,303,091 | B2 | 12/2007 | Lombari | |
| 7,322,488 | B2 | 1/2008 | Lombari et al. | |
| 7,354,495 | B2 * | 4/2008 | Carter | F17C 1/06 156/169 |
| 7,363,944 | B2 | 4/2008 | Lai | |
| 7,753,239 | B2 | 7/2010 | Chang | |
| 8,079,126 | B2 | 12/2011 | Bampton et al. | |
| 8,403,170 | B1 | 3/2013 | Lai | |
| 2004/0173624 | A1 | 9/2004 | Carter | |
| 2006/0131314 | A1 | 6/2006 | Lombari et al. | |
| 2008/0017653 | A1 | 1/2008 | Carter | |
| 2011/0309084 | A1 | 12/2011 | Wang | |

* cited by examiner

PRESSURE VESSEL SYSTEM AND METHOD

CROSS-REFERENCE TO RELATED APPLICATIONS

This application claims the benefit of the filing date of U.S. provisional patent application Ser. No. 61/881,877 entitled "MECHANICAL JOINT FOR PRESSURE VESSEL SYSTEM AND METHOD" filed Sep. 24, 2013, and U.S. provisional patent application Ser. No. 61/926,862 entitled "AIR STEM CAP AND DIAPHRAGM HYDROSTATIC RESTRICTOR FOR PRESSURE VESSEL SYSTEM AND METHOD" filed Jan. 13, 2014, the entire contents of which are incorporated by reference herein for all purposes.

BACKGROUND

A pressure vessel or pressure tank is normally utilized in industrial and residential pressurized water systems as an accumulator tank for the storage of water. However, pressure vessels are also used to store and transmit other liquids, vapors, and gases under pressure. The pressure vessel is generally connected in line with a supply source that includes a pumping device. The pressure vessel can supply water under pressure for low demand periods without requiring the pumping device to turn on. For higher demand periods, the pressure vessel may allow the pump to run for recommended minimum periods while not interrupting the demand requirements. In order for the pressure vessel to act in this manner, air under pressure contained in the vessel is compressed as water is pumped into the vessel. As more water enters the vessel, a pressure rise results, and the pump will shut off at a predetermined sensed pressure. The cycle will not repeat until a demand relieves the vessel pressure to a predetermined low sensed pressure, which will turn on the pump to refill the pressure vessel.

Typically, the pressure vessel includes two complementary cup-shaped sections that are made of metal, which requires assembly with, e.g., welding to, a metal clamp ring that is disposed inside of the two tank sections. The pressure vessel may further include a valve stem typically disposed in an upper portion of the vessel for measuring air pressure inside of the pressure vessel. The valve stem is often covered by a cap to inhibit interference or damage to the valve stem. A typical pressure vessel is relatively expensive and labor and time intensive to manufacture. Moreover, metal pressure vessels can corrode from external environmental exposure, which can lead to deterioration of the pressure vessel and the water system. Such deterioration can lead to undesirable results, such as leaking vessels.

Conventional pressure vessels also include a separator bag or deformable diaphragm that divides the vessel into two sections. The diaphragm separates gas in one section of the vessel from water in the other section of the vessel and the rest of the system. The gas section is pre-charged with gas under pressure so that the diaphragm is displaced to increase or decrease the volume of the gas section according to the variations of the volume of water in the other section. An air valve extends through one end of the vessel, and an inlet and outlet aperture is provided at the other end of the vessel for fluid communication with the water system. As water is pumped into the vessel, the bag or diaphragm is forced upwardly by the incoming water.

Additionally, the separator bags or diaphragms are usually attached to the pressure vessels in one of two ways. First, the separator bags are either peripherally sealed, or otherwise attached to the sidewall of the pressure vessel, usually at an assembly seam. Second, the pressure vessel may include a removable cell (including the separator bag) that may be removed and replaced upon failure. Both arrangements have advantages and disadvantages. The primary advantage of a diaphragm-type separator attached to, or peripherally sealed to, the sidewall is that the diaphragm may be constructed from a relatively heavy gauge plastic or rubber material, and may be shaped to conform to the cross-section of the vessel or in a manner to eliminate stretching. This arrangement, however, involves the problem of providing a pressure-tight seal between the mating halves of the pressure vessel and between the sidewall of the vessel and the diaphragm. For the sake of economy, attempts have been made to combine the seal between the vessel halves and the seal between the diaphragm and the sidewall into a single assembly. This arrangement, however, has not been entirely successful and may result in vessel leakage. Furthermore, these attachment arrangements usually involve protruding flanges and clamps on the exterior of the vessel that interfere with attempts to helically wind the vessel for added reinforcement (e.g., using a filament winding process).

One known system discloses a split tank closure and diaphragm assembly for a hydropneumatic filament wound pressure vessel. The assembly includes first and second cup shaped plastic tank liners having oblate ellipsoidal end portions and cylindrical sidewall portions terminating in cylindrical open mouth portions. A ring is provided for joining and sealing the open mouth portions together to form a sealed container and to mount a diaphragm within the tank to divide the interior of the tank into variable volume chambers. However, the mounting ring and diaphragm are separate elements that may not provide a pressure-tight seal between the first and second cup shaped plastic tank liners of the pressure vessel and between the sidewall of the vessel and the diaphragm.

Another known system discloses a water pressure tank for use with pumping systems. The water pressure tank includes a pair of tank sections having matching open ends, surrounded by assembly flanges. The assembly flanges are provided with matching bolt holes so that the pair of tank sections can be united by bolts. A peripheral rim of a diaphragm having concentric circular corrugations is clamped between the assembly flanges. Thus, the diaphragm is permitted to expand in either direction from an intermediate position within the pressure tank. However, the assembly flanges protrude outwardly beyond an outer surface of the pressure tank and may interfere with attempts to helically wind the tank for added reinforcement (using a filament winding process).

In addition, if loss of pneumatic pressure is encountered, the diaphragm is typically not restricted from movement within the pressure tank causing the pressure tank to become completely filled with water. This undesirable condition may be the result of a faulty o-ring, a valve stem malfunction, or a worn valve stem cap, for example. Attempts have been made to combine a diaphragm restrictor and the seal between the diaphragm and the sidewall in a single assembly. This arrangement, however, has not been entirely successful and tank malfunction and leakage has resulted.

Further, conventional valve stem and valve cap assemblies do not extend, or extend a small amount, beyond the top of the pressure vessel, making it difficult to access the valve stem to check the vessel pressure. Additionally, conventional pressure vessels often include a valve cap that covers the valve stem and a separate pole piece cap that covers the valve stem and valve cap assembly. The various cap assemblies may be relatively expensive and time intensive to manufacture. Moreover, conventional valve stems tend to develop slow leaks over time due to improper sealing mechanisms in the various cap assemblies, which may lead to incorrectly pressurized vessels.

Therefore, it would be desirable to provide a non-metallic vessel assembly that does not affect the quality or taste of water being held in the vessel and does not deteriorate over time in a corrosive environment. It would also be desirable to provide a non-metallic vessel assembly with an internal diaphragm that is seamlessly installed and interposed between the water chamber and the gas chamber to separate the water from pressurized gas and provides a positive seal between vessel liners. Furthermore, it would be desirable to provide a non-metallic, diaphragm-type vessel assembly that can be mechanically locked together with fiberglass winding tension and can withstand the internal pressures normally associated with vessel assemblies.

It would also be desirable to provide a vessel assembly that provides easy access to the valve stem for checking vessel pressure while at the same time protects the air stem from damage during transit and normal use. It would also be desirable to provide a vessel assembly that seals the air stem from the valve stem to inhibit air leaks, as well as protect the air stem from debris. Furthermore, it would be desirable to provide a diaphragm-type vessel assembly that combines the support ring and a hydrostatic restrictor into one component that provides compression on the diaphragm joint connection and limits the hydraulic movement of the diaphragm, thereby allowing hydraulic pressure or pneumatic pressure to freely pass through the pressure vessel during normal use.

SUMMARY

Some embodiments of the invention provide a joint system for a pressure vessel including a first tank liner having a first circumferential side wall and a first end portion offset from the first circumferential side wall to form a first outer annular recess. The joint system may also include a second tank liner having a second circumferential side wall and a second end portion offset from the second circumferential side wall to form a second outer annular recess. A convoluted diaphragm may divide the pressure vessel into a pair of chambers sealed relative to each other and may be positioned between the first tank liner and the second tank liner. An H-ring may have a first circumferential groove and a second circumferential groove. The first circumferential groove may be configured to receive the first end portion of the first tank liner and the second circumferential groove may be configured to receive the second end portion of the second tank liner. Fiberglass windings may surround the first tank liner and the second tank liner in tension and may be configured to lock the first tank liner and the second tank liner together.

Other embodiments of the invention provide a joint system for a pressure vessel including a first tank liner having a first circumferential side wall and a first end portion offset from the first circumferential side wall to form a first outer annular recess. The joint system may also include a second tank liner having a second circumferential side wall and a second end portion offset from the second circumferential side wall to form a second outer annular recess. An H-ring over-molded with a polymeric material may have a first circumferential groove and a second circumferential groove. In another embodiment, the H-ring may be included in the joint system without the overmolding of a polymeric material. The first circumferential groove may be configured to receive the first end portion of the first tank liner and the second circumferential groove may be configured to receive the second end portion of the second tank liner. Fiberglass windings may surround the first tank liner and the second tank liner in tension and are configured to lock the first tank liner and the second tank liner together.

Another embodiment of the invention provides a joint system for a pressure vessel including a first tank liner having a first circumferential side wall and a first end portion vertically aligned with first circumferential side wall. The joint system may also include a second tank liner having a second circumferential side wall and a second end portion offset from the second circumferential side wall. The second end portion may have a first outwardly facing annular groove and a second outwardly facing annular groove. A convoluted diaphragm may divide the pressure vessel into a pair of chambers sealed relative to each other and having an outer wall portion to snap-fit the first tank liner and the second tank liner together. The outer wall portion may include a first inwardly facing circumferential bead that engages the first outwardly facing annular groove to provide a seal. A second inwardly facing circumferential bead may engage the second outwardly facing annular groove to provide a seal so that the outer wall portion is positioned vertically between the first end portion of the first tank liner and the second end portion of the second tank liner.

In yet another embodiment of the invention a method of joining tank liner sections together for a pressure vessel system is provided. The method includes providing a first tank liner having a first circumferential side wall and a first end portion offset from the first circumferential side wall to form a first outer annular recess. A second tank liner having a second circumferential side wall and a second end portion offset from the second circumferential side wall may be provided to form a second outer annular recess. An H-ring with a convoluted diaphragm may be over-molded and include a first circumferential groove and a second circumferential groove. In another embodiment, the H-ring may be provided without overmolding of a polymeric material. The first circumferential groove may engage the first end portion of the first tank liner, and the convoluted diaphragm may be positioned between the first tank liner and the second tank liner to divide the pressure vessel into a pair of chambers sealed relative to each other. The second circumferential groove may engage the second end portion of the second tank liner, and the first tank liner and the second tank liner may be surrounded with fiberglass windings in tension to lock the first tank liner and the second tank liner together.

Other embodiments of the invention provide a cap system for a pressure vessel including an air stem having a first end portion and a second end portion. The air stem axially extends through a circular recess of the pressure vessel. The first end portion and the second end portion of the air stem each have external threads. The cap system also includes a valve cap having internal threads that is configured to engage the external threads of the first end portion of the air stem. A washer is positioned inside the valve cap and is configured to seal air within the air stem and valve cap. An outer cap covers the circular recess of the pressure vessel and has a hollow cavity extending downwardly from a central portion of the outer cap. The hollow cavity has a shape substantially the same as the valve cap, and the valve cap is configured to be anchored to the outer cap.

Other embodiments of the invention provide a method for capping an air stem for a pressure vessel system. The method includes inserting an internally threaded fastener into an aperture of a valve guard formed within a circular recess of the pressure vessel system. An air stem having a first end portion and a second end portion with external threads may be provided. The second end portion of the air stem is engaged with the internally threaded fastener, and a washer is inserted into a valve cap having internal threads. An outer cap is provided that covers the circular recess of the pressure vessel. The outer cap includes a hollow cavity downwardly extending from a central portion of the outer cap that has a shape that corresponds to the valve cap. The valve cap is press-fitted into the outer cap and the internal threads of the valve cap are coupled to the externally threaded end portion of the air stein to provide a substantially air tight and substantially water tight seal.

Another embodiment of the invention provides a diaphragm restrictor system for a pressure vessel including a first tank liner having a first circumferential side wall and a first end portion vertically aligned with the first circumferential side wall. The diaphragm restrictor system may also include a second tank liner having a second circumferential side wall and a second end portion offset from the second circumferential side wall. A diaphragm is provided that divides the pressure vessel into a pair of chambers sealed relative to each other and having an outer wall portion positioned vertically between the first end portion of the first tank liner and the second end portion of the second tank liner. A restrictor having an integrally formed circumferential support ring is positioned between the pair of chambers. The integrally formed support ring may be configured to engage the offset second end portion of the second tank liner. In addition, the restrictor is configured to limit upward movement of the diaphragm within the pressure vessel and to compress the outer wall portion of the diaphragm between the first end portion of the first tank liner and the second end portion of the second tank liner. The hydrostatic restrictor can also be functional without the convolution portion of the diaphragm, whereas the diaphragm joint section would only be used to seal the upper and lower tank halves.

In yet another embodiment of the invention, a method for restricting a diaphragm within a pressure vessel system is provided. The method includes providing a first tank liner having a first circumferential side wall and a first end portion vertically aligned with the first circumferential side wall. A second tank liner having a second circumferential side wall and a second end portion offset from the second circumferential side wall is provided. A diaphragm is positioned between the first tank liner and the second tank liner to divide the pressure vessel into a pair of chambers sealed relative to each other. The diaphragm may have an outer wall portion positioned vertically between the first end portion of the first tank liner and the second end portion of the second tank liner. In addition, a restrictor having an integrally formed circumferential support ring is positioned between the pair of chambers to limit upward movement of the diaphragm within the pressure vessel and to compress the outer wall portion of the diaphragm between the first end portion of the first tank liner and the second end portion of the second tank liner. The restrictor can also be functional without the convolution portion of the diaphragm, whereas the diaphragm joint section may only be used to seal the upper and lower tank halves.

In another embodiment of the invention, a pressure vessel is provided. The pressure vessel includes a joint for locking a first tank liner and a second tank liner together. The pressure vessel further includes a cap system coupled to the second tank liner. The cap system includes an air stem extending beyond a recess of the pressure vessel to provide access to the air stem for acquiring a pressure within the pressure vessel. A diaphragm restrictor is coupled to the joint, and the diaphragm restrictor divides the pressure vessel into a pair of chambers. The diaphragm restrictor is also configured to limit upward movement of a diaphragm within the pressure vessel.

These and other features, aspects, and advantages of the present invention will become better understood upon consideration of the following detailed description, drawings, and appended claims.

DETAILED DESCRIPTION

Figure 1:
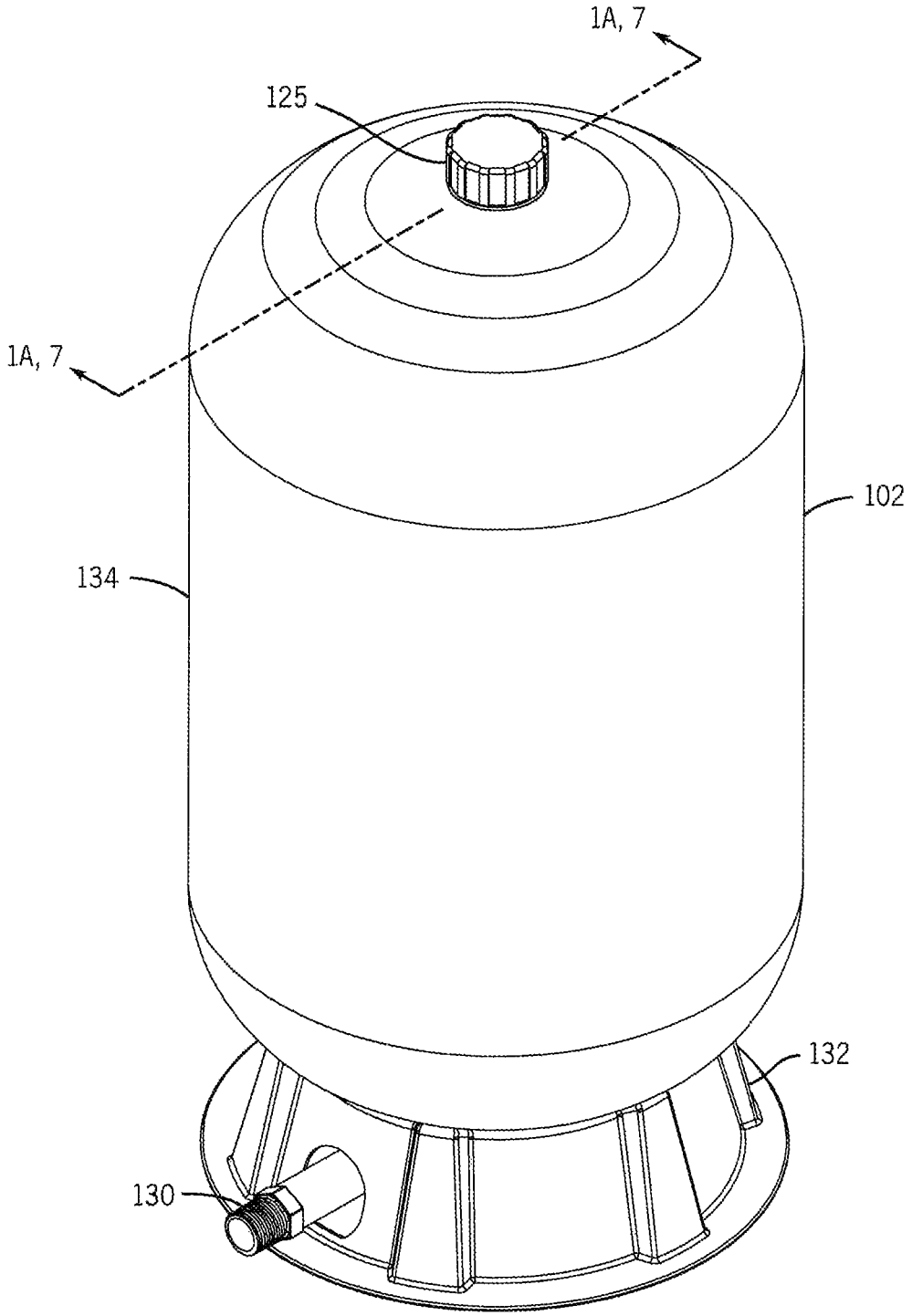
FIG. 1 is an isometric view of a pressure vessel according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

A pressure vessel or tank is normally utilized in industrial and residential pressurized water systems for stabilizing water pressure and absorbing water hammers. A pressure vessel is typically made of metal and pressurized by a gaseous or liquid medium. In typical applications, pressure vessels are employed to supply a liquid substance, such as water, by means of pressurized air from a container placed in the pressure vessel via a supply line to a location where the water or other liquid is used.

Figure 1B:
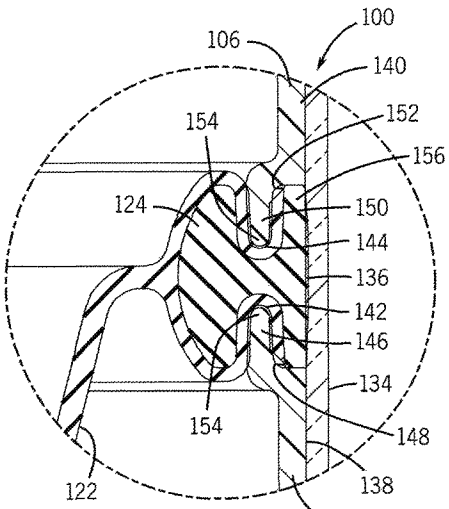
FIG. 1B is an enlarged cross-sectional view of a portion of the joint system of FIG. 1A.
Figure 1A:
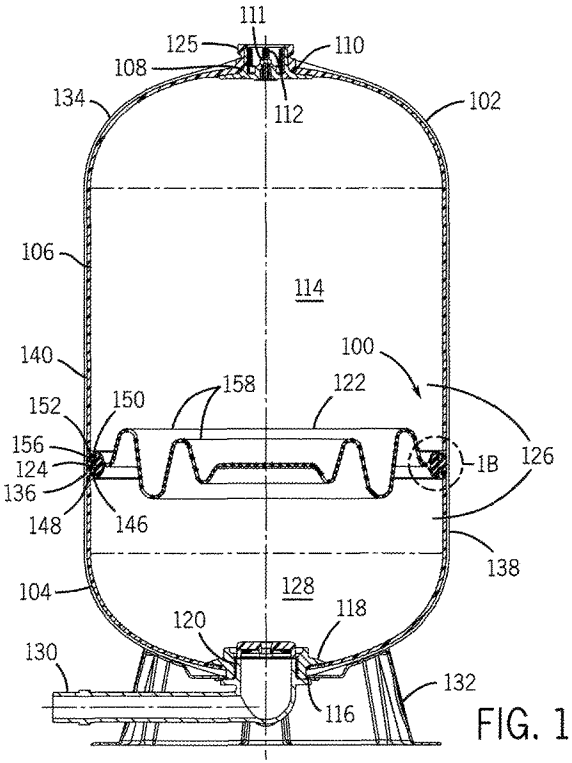
FIG. 1A is a cross-sectional view of the pressure vessel of FIG. 1 taken along line 1A-1A of FIG. 1 including a convoluted diaphragm attached to the pressure vessel by a joint system according to one embodiment of the invention.

FIGS. 1, 1A, and 1B illustrate a pressure vessel 102 according to one embodiment that is supported by a stand 132. The pressure vessel 102 includes a joint system 100 designed to retain, support, and/or join various components within the interior of the pressure vessel system 102. The pressure vessel 102 is substantially cylindrical in shape and generally includes a valve stem 112 coupled to an air stem 111, a first and a second tank liner 104, 106, a diaphragm 122, and an inlet 116. It is contemplated that the pressure vessel 102 may be utilized in any of the environments described herein.

As shown in FIG. 1A, the valve stem 112 is centrally disposed in an upper portion of the vessel 102. The valve stem 112 may be a self-contained valve, for example, that opens to admit gas to the pressure vessel 102, and is automatically closed by pressure in the pressure vessel 102 to inhibit the gas from escaping. The valve stem 112 is coupled to the air stem 111 that extends into the pressure vessel 102, thereby creating a passageway from the valve stem 112 to the inside of the pressure vessel 102. Thus, the valve stem 112 is designed to measure air pressure inside of the pressure vessel 102. The valve stem 112 is covered by a cap 125, which upon removal, provides access to the valve stem 112.

The pressure vessel 102 may be a fiberglass reinforced pressure vessel, for example, and is defined by a first tank liner 104 and a second tank liner 106. The first tank liner 104 and the second tank liner 106 are cup shaped liners that may be constructed of thermoplastic, for example. However any suitable, non-corrosive material may be used to form the first tank liner 104 and the second tank liner 106. The first tank liner 104 and the second tank liner 106 are separated by a diaphragm 122 (e.g., convoluted diaphragm) that over molds an H-ring 124. The convoluted diaphragm 122 may separate the pressure vessel 102 into a pair of chambers 126 including an upper pressure chamber 114 and a lower water chamber 128 to form a hydropneumatic tank. The first tank liner 104 and the second tank liner 106 may be injection molded or may be formed by other molding techniques.

The outer surface of each of the first tank liner 104 and the second tank liner 106 may be filament wound in a helical pattern, for example, by resin impregnated rovings, such as resin impregnated continuous glass fibers 134, by employing conventional filament winding techniques. By surrounding the first tank liner 104 and the second tank liner 106 in tension with the glass fibers 134, a mechanical locking mechanism is formed to lock the first tank liner 104 and the second tank liner 106 to the H-ring 124, convoluted diaphragm 122 combination, thereby forming a positive water tight and air tight pressure seal 154 (see FIG. 1B). The seal 154 may be advantageous, especially during the cyclic and high pressure requirements of the pressure vessel 102.

As shown in FIG. 1A, the second tank liner 106 may be provided with a circular recess 108 at a top portion of the pressure vessel 102. The circular recess is configured to receive a cup shaped valve guard 110 that may be held or otherwise fastened within the recess 108. A conventional one way check valve, such as a conventional tire valve 112, may be provided within the valve guard 110 and extend through the valve guard 110 and the second tank liner 106 to provide fluid communication with the pressure chamber 114 within the pressure vessel 102.

The first tank liner 104 may be provided with an inlet 116 at a bottom portion of the pressure vessel 102. The inlet 116 may be configured to receive a tank bottom fitting 118 having a threaded axis opening 120 extending into the water chamber 128. The tank bottom fitting 118 may be coupled to a water connection 130 and may be sealed within the inlet 116 by suitable electromagnetic heating techniques, a suitable adhesive, and/or both. Alternatively, the tank bottom fitting 118 may be molded as an integral part of the first tank liner 104.

As shown in FIG. 1B, the first tank liner 104 and the second tank liner 106 may be retained in mouth to mouth apposition to form a sealed container by the joint system 100. The joint system 100 may provide a mechanical locking mechanism to hold the first tank liner 104 and the second tank liner 106 together and may be defined by the integration of the H-ring 124 that may be over-molded by the convoluted diaphragm 122. In one embodiment, the H-ring 124 may be constructed of a polymer such as rubber (e.g., butyl rubber), however any suitable material for sealing the first tank liner 104 and the second tank liner 106 may be used.

The H-ring 124 is defined by a cylindrical outer surface 136 corresponding to the outside diameter of a first circumferential side wall 138 and a second circumferential side wall 140 of the first tank liner 104 and the second tank liner 106, respectively. The H-ring 124 is further defined by a first circumferential groove 142 and a second circumferential groove 144. The first circumferential groove 142 is vertically aligned with and inverted relative to the second circumferential groove 144, as shown in FIG. 1B. The first circumferential groove 142 is configured to receive a first end portion 146 of the first tank liner 104. The first end portion 146 may be offset relative to the first circumferential side wall 138 to form a first outer annular recess 148. Similarly, the second circumferential groove 144 is configured to receive a second end portion 150 of the second tank liner 106. The second end portion 150 may be offset relative to the second circumferential side wall 140 to form a second outer annular recess 152. The first outer annular recess 148 and the second outer annular recess 152 may be dimensioned to engage a circumferential rib 156 of the H-ring 124.

Figure 2A:
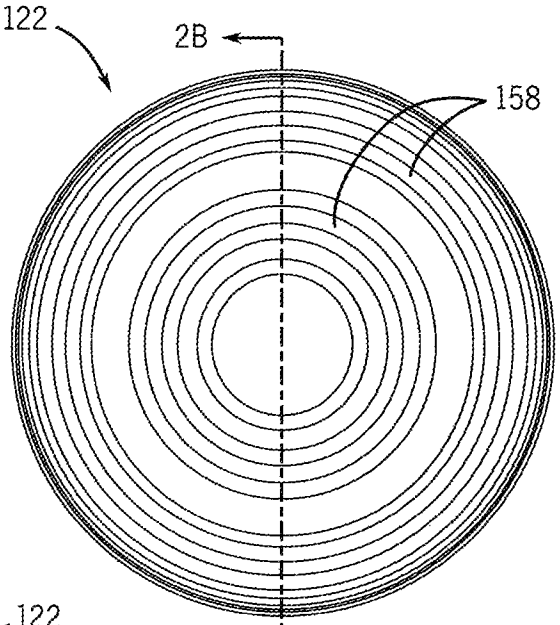
FIG. 2A is a top plan view of the convoluted diaphragm of FIG. 2.
Figure 2:
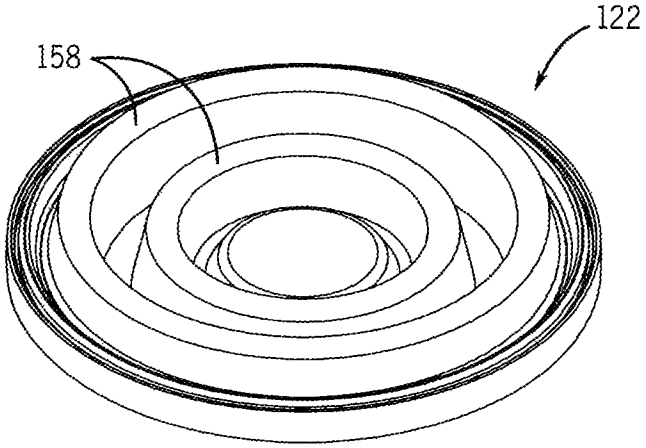
FIG. 2 is an isometric view of the convoluted diaphragm of FIG. 1A removed from the pressure vessel for clarity.
Figure 2B:
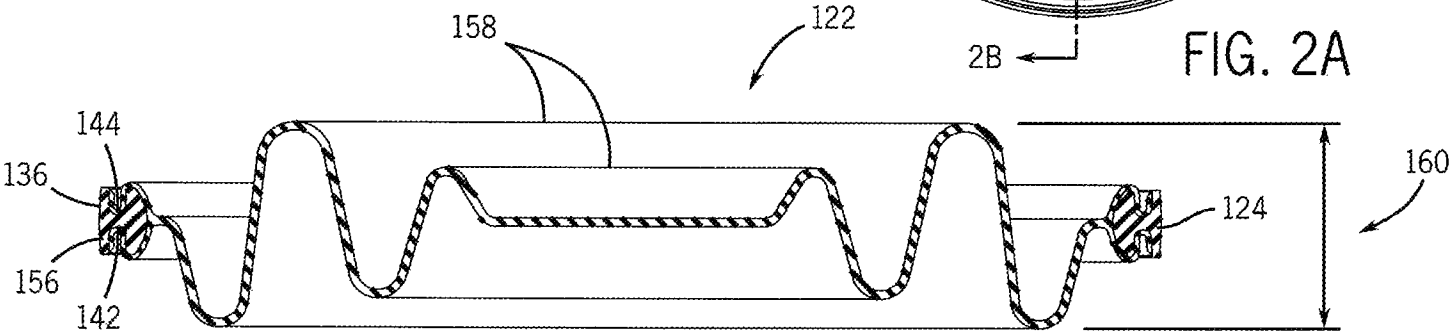
FIG. 2B is a cross-sectional view of the convoluted diaphragm of FIG. 2A taken along the line 2B-2B of FIG. 2A.

As shown in FIGS. 2, 2A and 2B, the H-ring 124 is fully integrated with the convoluted diaphragm 122 in a linear diaphragm free state. In some embodiments, the linear diaphragm free state height 160, as shown in FIG. 2B, may be between about 6.5 centimeters and about 8.5 centimeters. In some instances, the linear diaphragm free state height 160 may be equivalent to a predetermined air pre-charge value and a predetermined maximum water capacity height to minimize deformation and stress on the convoluted diaphragm 122. The predetermined air pre-charge value may be a height that is measured when a pressure in the pressure chamber 114 is at a suitable level to maintain the desired pressure in the pressure vessel 102. Similarly, the predetermined maximum water capacity height may be determined by a volume of water that is measured in the lower water chamber 128 of the pressure vessel 102 to maintain the pressure in the pressure vessel. Thus, the convoluted geometry of the convoluted diaphragm 122 minimizes the stress on the diaphragm at maximum displacement conditions.

The convoluted diaphragm 122 may be preformed with one or more concentric circular corrugations 158, as best shown in FIGS. 2 and 2B. The concentric circular corrugations 158 may enable the convoluted diaphragm 122 to expand into either the water chamber 128 or the pressure chamber 114 of the pressure vessel 102, without stretching the material of the convoluted diaphragm 122. In some embodiments, the material used for construction of the convoluted diaphragm 122 may be sufficiently rubber like, or pliant, to provide the required resilience. The material of the convoluted diaphragm 122 is sufficiently durable and can withstand high chlorine exposure, standard sanitizing agents, as well as account for large displacements that occur on the pressure vessel 102, while still providing the required resilience. The material of the convoluted diaphragm 122 may also have high chlorine resistance and provide low gas permeation rates. Additionally, the design of the convoluted diaphragm 122 fully integrated with the H-ring 124, as shown in FIGS. 2, 2A and 2B, may minimize tooling costs of the rubber injection molded convoluted diaphragm 122.

Figure 3:
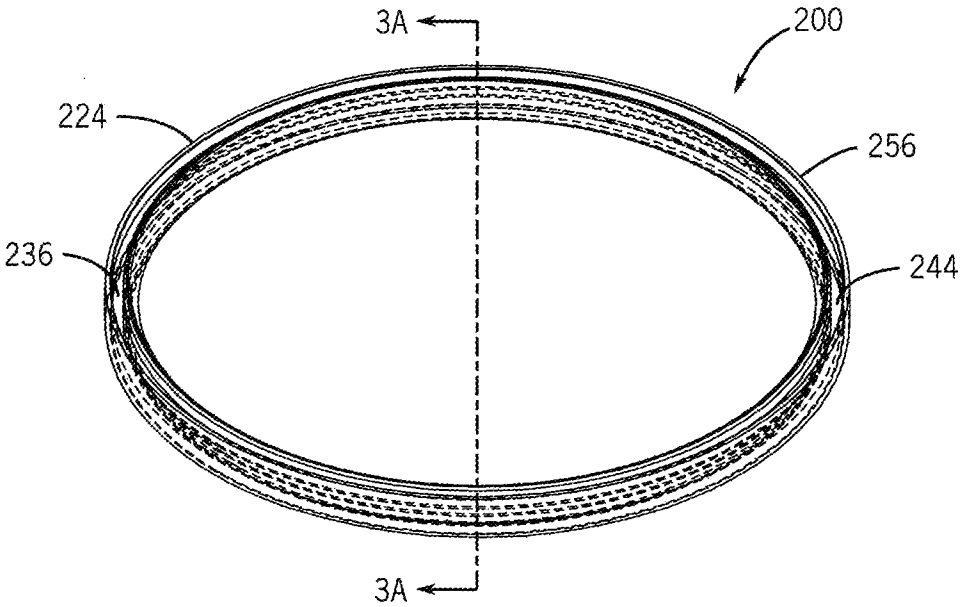
FIG. 3 is an isometric view of an H-ring for joining pressure tank liners together according to another embodiment of the invention.
Figure 3A:
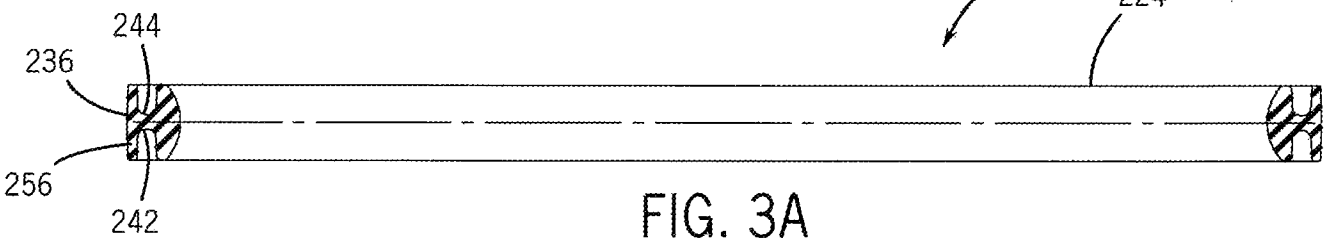
FIG. 3A is a cross-sectional view of the H-ring of FIG. 3 taken along line 3A-3A of FIG. 3.

In another embodiment, as shown in FIGS. 3 and 3A, a joint system 200, similar to the joint system 100 previously described, and therefore using similar reference numerals, may provide a mechanical locking mechanism to hold the first tank liner 104 and the second tank liner 106 together in absence of the convoluted diaphragm 122. In some embodiments, the joint system 200 may be defined by the integration of the H-ring 224 over-molded with a polymeric material such as butyl rubber. In other embodiments, the H-ring 224 may not be over-molded, or may be over-molded with one or more other materials. However, any suitable material may be used to over-mold the H-ring 224 in order to provide sufficient sealing between the first tank liner 104 and the second tank liner 106.

The H-ring 224 is defined by the cylindrical outer surface 236 corresponding to the outside diameter of the first circumferential side wall 138 and the second circumferential side wall 140 of the first tank liner 104 and the second tank liner 106, respectively. The H-ring 224 is further defined by the first circumferential groove 242 and the second circumferential groove 244. The first circumferential groove 242 is vertically aligned with and inverted relative to the second circumferential groove 244, as shown in FIG. 3A. The first circumferential groove 242 is configured to receive the first end portion 146 of the first tank liner 104. The first end portion 146 may be offset relative to the first circumferential side wall 138 to form the first outer annular recess 148 as shown in FIG. 1B. Similarly, the second circumferential groove 244 is configured to receive the second end portion 150 of the second tank liner 106. The second end portion 150 may be offset relative to the second circumferential side wall 140 to form the second outer annular recess 152. The first outer annular recess 148 and the second outer annular recess 152 may be dimensioned to engage a circumferential rib 256 of the H-ring 224.

Figure 4A:
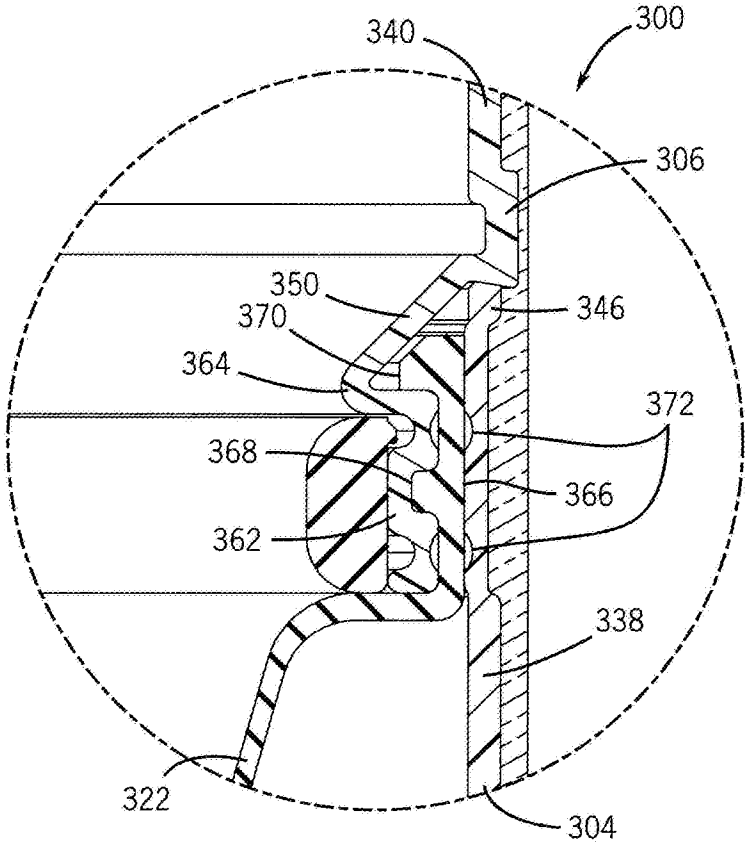
FIG. 4A is an enlarged cross-sectional view of a portion of the joint system of FIG. 4.
Figure 4:
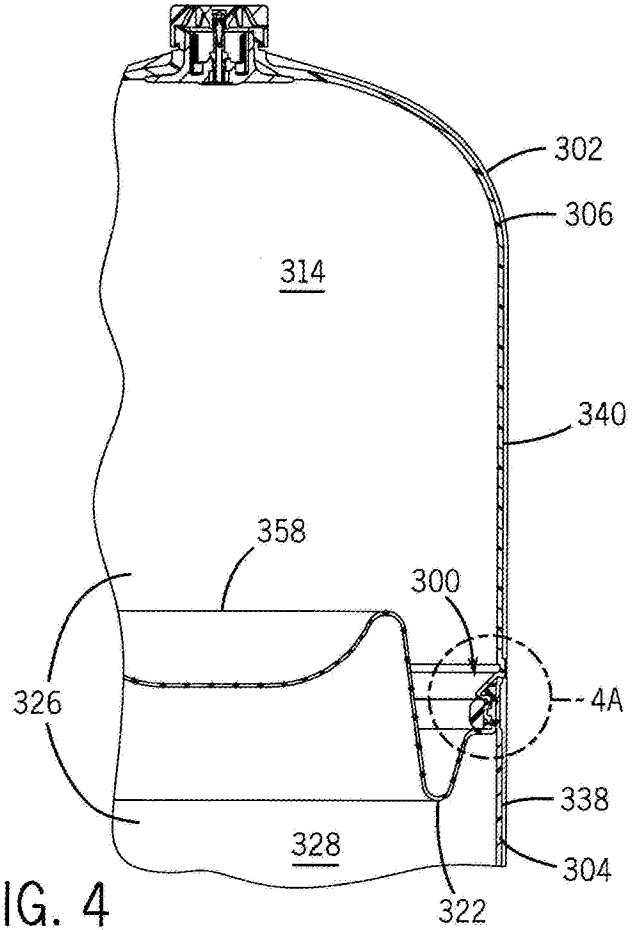
FIG. 4 is a partial cross-sectional view of a joint system for use in a pressure vessel according to another embodiment of the invention.

In another embodiment, as shown in FIGS. 4 and 4A, a joint system 300, similar to the joint system 100 previously described, and therefore using similar reference numerals, may provide a mechanical locking mechanism to hold the first tank liner 304 and the second tank liner 306 together using a snap-fit mechanism. The joint system 300 includes the convoluted diaphragm 322 that may be preformed with concentric circular corrugations 358 to enable the convoluted diaphragm 322 to expand into either the water chamber 328 or the pressure chamber 314 of the pressure vessel 302.

Rather than using the H-ring 124 as described with respect to the joint system 100, the convoluted diaphragm 322 includes an outer wall portion 366, as shown in FIG. 4A, having a first inwardly facing circumferential bead 368, a second inwardly facing circumferential bead 370, and a pair of circumferential beads 372 on opposing sides of and surrounding the first inwardly facing circumferential bead 368. The outer wall portion 366 may be configured to snap-fit vertically between the first end portion 346 of the first circumferential side wall 338 of the first tank liner 304 and the second end portion 350 of the second circumferential side wall 340 of the second tank liner 306. The first end portion 346 may be vertically aligned with the first circumferential side wall 338 of the first tank liner 304. In contrast, the second end portion 350 may be offset from the second circumferential side wall 340 of the second tank liner 306. The second end portion 350 of the second circumferential side wall 340 may include a first outwardly facing annular groove 362 and a second outwardly facing annular groove 364 configured to receive the first inwardly facing circumferential bead 368 and the second inwardly facing circumferential bead 370, respectively, thereby creating a snap-fit mechanism to hold the first tank liner 304 and the second tank liner 306 together.

Figure 5A:
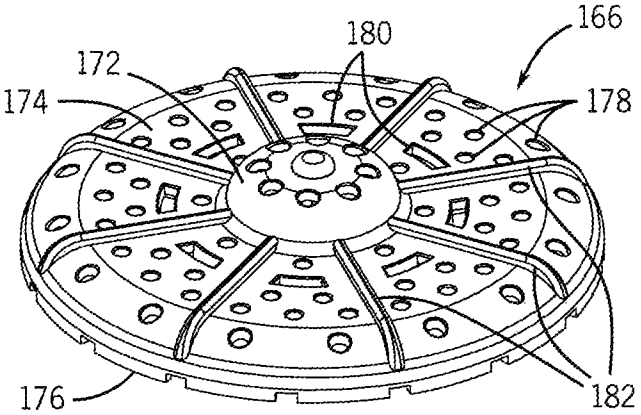
FIG. 5A is an isometric view of the top of the grid plate of FIG. 5.
Figure 5B:
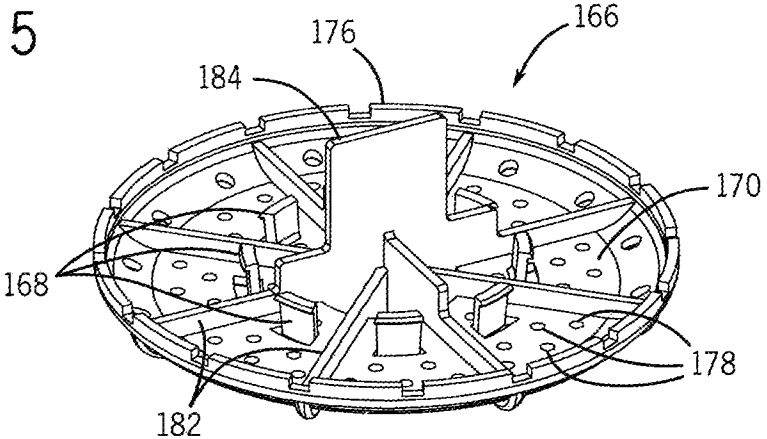
FIG. 5B is an isometric view of the bottom of the grid plate of FIG. 5 including a baffle.
Figure 5:
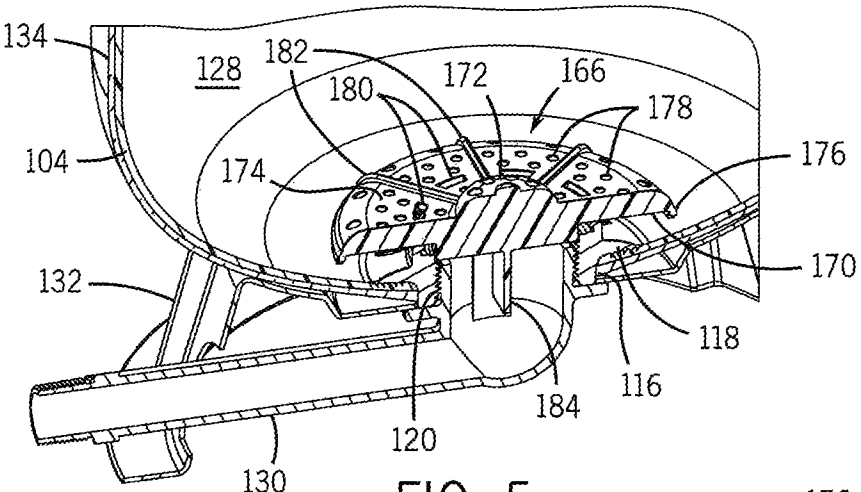
FIG. 5 is a cross-sectional view of a pressure vessel with a grid plate according to an embodiment of the invention.

Turning now to FIGS. 5, 5A and 5B, the joint systems 100, 200, 300 may include a substantially circular grid plate 166 coupled to the tank bottom fitting 118 at the inlet 116 of the first tank liner 104. The grid plate 166 may include prongs 168, as shown in FIG. 5B, that extend vertically downwardly from a plurality of circumferentially arranged slots 180 disposed on a bottom surface 170 of the grid plate 166 so the grid plate 166 may snap onto the tank bottom fitting 118. More specifically, the prongs 168 may be received by corresponding slots (not shown) disposed on a circumferential edge of the tank bottom fitting 118. The dimension of each slot may be slightly smaller than the prongs 168, so that when the prongs 168 are press fit into the slots, the grid plate 166 is snapped into the tank bottom fitting 118. In some embodiments, this snapping feature may allow for permanent installation of the grid plate 166 to the pressure vessel 102. In an alternative embodiment, the snapping feature may be reversible to allow the grid plate 166 to be removed from the tank bottom fitting 118.

Additionally, the grid plate 166 may have a dome shaped protrusion 172, as shown in FIG. 5A, integrally centered on a generally flat, disk-shaped central portion 174. The central portion 174 may be surrounded by an annular edge 176 that extends axially downward from the central portion 174, as shown in FIG. 5A. The grid plate 166 further includes a plurality of holes 178 for diffusing water, as well as a plurality of radially extending ribs 182 arranged between the plurality of circumferentially arranged slots 180. The grid plate 166 may also include a baffle 184, as shown in FIGS. 5 and 5B, coupled to the bottom surface 170 of the grid plate 166 to facilitate the diffusion and mixing of water through the plurality of holes 178. The grid plate 166 further provides the ability to drain water out of the pressure vessel 102 through the water connection 130. The grid plate 166 may be constructed of a polymer such as high density polyethylene (HDPE), for example, or any other suitable material.

Figure 6A:
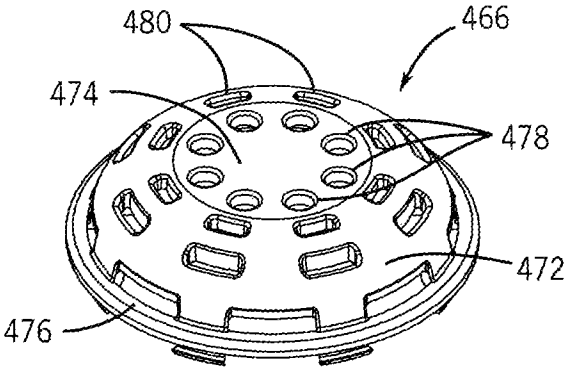
FIG. 6A is an isometric view of the top of the snap bottom diffuser of FIG. 6.
Figure 6B:
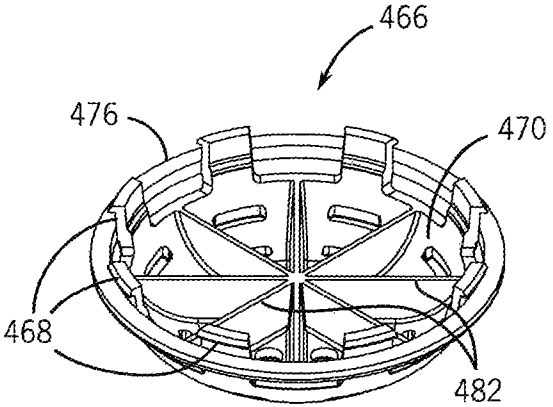
FIG. 6B is an isometric view of the bottom of the snap bottom diffuser of FIG. 6.
Figure 6:
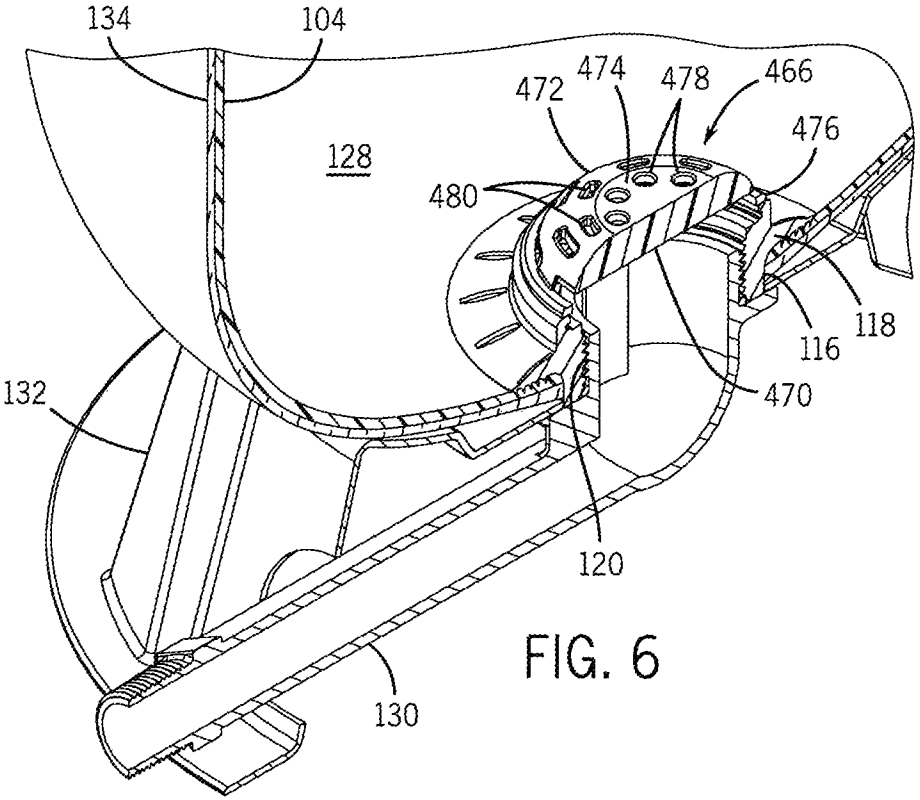
FIG. 6 is a cross-sectional view of a pressure vessel with a snap bottom diffuser including a screen according to another embodiment of the invention.

In an alternative embodiment, as shown in FIGS. 6, 6A and 6B, the joint systems 100, 200, 300 may include a bottom diffuser with a screen 466, similar to the grid plate 166 and thus similar reference numerals will be used to describe the features of the bottom diffuser 466. The bottom diffuser 466 may be coupled to the tank bottom fitting 118 at the inlet 116 of the first tank liner 104. The bottom diffuser 466 may include prongs 468, as shown in FIG. 6B, that extend vertically from the bottom surface 470 of the bottom diffuser 466 so the bottom diffuser 466 may snap onto the tank bottom fitting 118. More specifically, the prongs 468 may be received by a corresponding circumferential groove or slots (not shown) disposed on the circumferential edge of the tank bottom fitting 118. In some embodiments, this snapping feature may allow for permanent installation of the bottom diffuser 466 to the pressure vessel 102. In an alternative embodiment, the snapping feature may be reversible to allow the bottom diffuser 466 to be removed from the tank bottom fitting 118.

Additionally, the bottom diffuser 466 is defined by the dome shaped body 472 extending from the annular edge 476 and terminating at the central portion 474. The bottom diffuser 466 further includes the plurality of holes 478 for diffusing water, as well as the plurality of circumferentially arranged slots 480 that are separated by the plurality of radially extending ribs 482, as shown in FIG. 6B. The bottom diffuser 466 may also include one or more baffles (not shown), or another connection mechanism, coupled to the bottom surface 470 of the bottom diffuser 466 to facilitate the diffusion and mixing of water through the plurality of holes 478. The bottom diffuser 466 further provides the ability to drain water out of the pressure vessel 102, while inhibiting the diaphragm 122 from sealing the drain or extruding and puncturing the diaphragm 122. The bottom diffuser 466 may be constructed of high density polyethylene (HDPE) or acrylonitrile butadiene styrene (ABS), for example, or any other suitable material.

Figure 7:
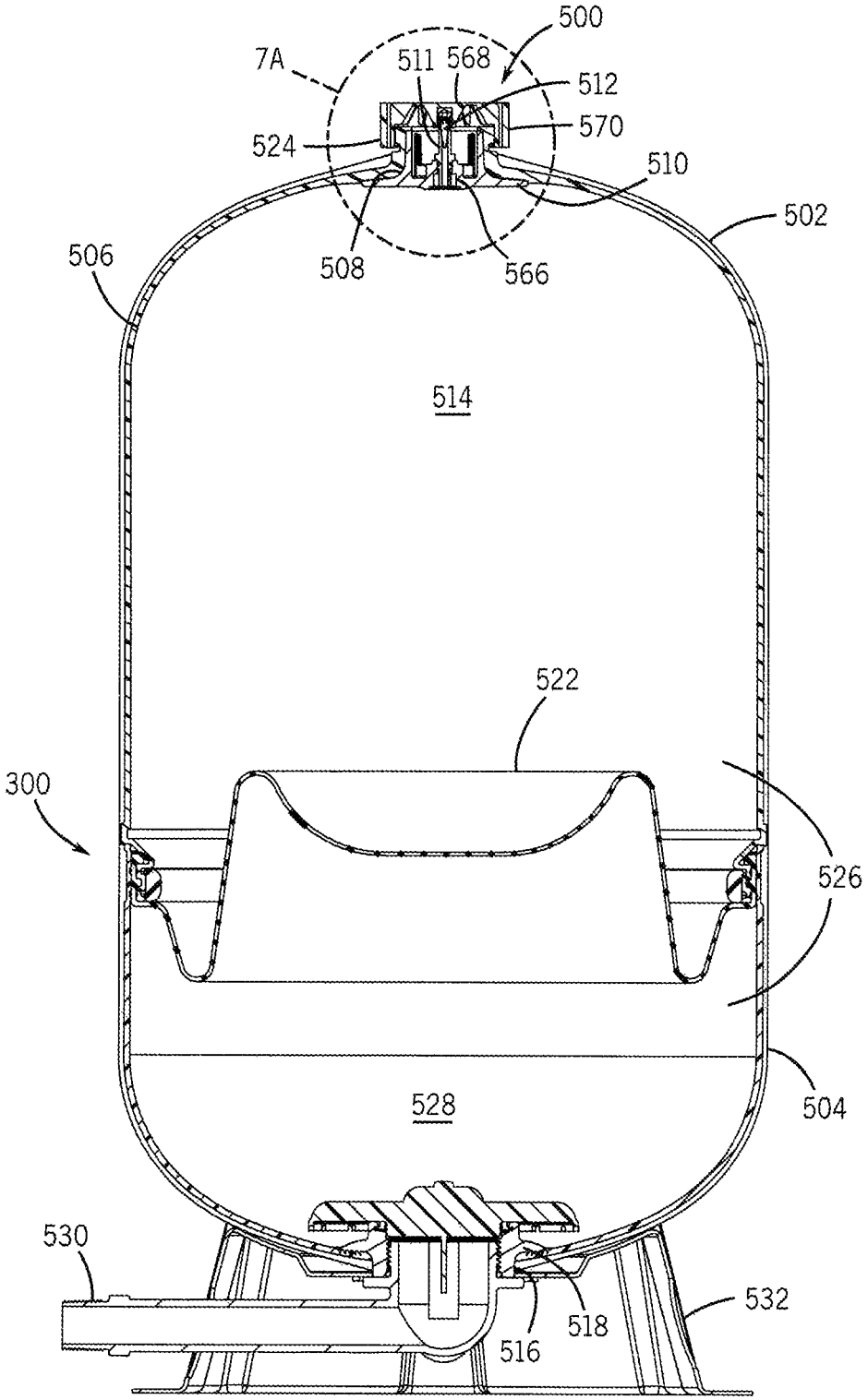
FIG. 7 is a cross-sectional view of a pressure vessel taken along line 7-7 of FIG. 1 including a cap system attached to the pressure vessel according to one embodiment of the invention.

Turning now to FIG. 7, a cap system 500 for the pressure vessel 502 is shown. The cap system 500 may be incorporated into any of the pressure vessels described herein, and similar reference numerals are used to describe similar components. As shown in FIG. 7, the cap system 500 is incorporated into the pressure vessel 502 and joint system 300, similar to the pressure vessel 302 and joint system 300 shown in FIG. 4. Alternatively, the cap system 500 may also be incorporated into the pressure vessel 102 and joint system 100 shown in FIG. 1A, or into any combination of pressure vessels and joint systems described herein. As previously described, the pressure vessel 502 is supported by the stand 532 and is formed by the first tank liner 504 and the second tank liner 506. The first tank liner 504 and the second tank liner 506 are cup shaped liners that may be separated by the convoluted diaphragm 522, thus separating the pressure vessel 502 into the pair of chambers 526. The pair of chambers 526 are defined by the upper pressure chamber 514 and the lower water chamber 528 to form the hydropneumatic tank. In some embodiments, the pressure vessel 502 can also be functional without the convoluted portion of the diaphragm 522, whereas the diaphragm joint system 300 may be used to seal the first tank liner 504 and the second tank liner 506.

The second tank liner 506 may be provided with the circular recess 508 configured to receive the cup shaped valve guard 510 that may be fastened within the recess 508. A one way check valve, such as the conventional valve stem 512, may be provided within the valve guard 510 and extend through the valve guard 510 and the second tank liner 506 for fluid communication with the pressure chamber 514 within the pressure vessel 502.

The first tank liner 504 may be provided with the inlet 516 configured to receive the tank bottom fitting 518 with the threaded axis opening that extends into the water chamber 528. The tank bottom fitting 518 may be coupled to the water connection 530 and may be sealed within the inlet 516 by suitable electromagnetic heating techniques or a suitable adhesive or both. Alternatively, the tank bottom fitting 518 may be molded as an integral part of the first tank liner 504.

As shown in FIGS. 7A, 7B, 7C, and 7D the cap system 500 is designed to provide a sealing mechanism for the air stem 511 to inhibit potentially slow air leaks, for example, in the valve stem 512. In addition, the cap system 500 combines the valve cap 520 and an outer cap 524 into a one-part assembly. In general, the cap system 500 includes the valve cap 520 anchored to, or otherwise joined to, the outer cap 524. A washer 536 is positioned inside the valve cap 520 to provide the sealing mechanism and the threaded air stem 511 engages the valve cap 520 and the valve guard 510 by rotational threading. The valve stem 512 is coupled to the air stem 511, and a fastener 566 couples the air stem 511 to the valve guard 510. The air stem 511 and the valve stem 512 extend above the circular recess 508 of the pressure vessel 502 to facilitate easy access to the valve stem 512 for measuring the air pressure inside the pressure vessel 502 using a conventional pressure gauge (e.g., tire pressure gauge).

More particularly, in some embodiments, the outer cap 524 is substantially cylindrical in shape and may be formed by injection molding using a thermoplastic, such as polypropylene or polyethylene, for example. In an alternative embodiment, the outer cap 524 may be provided in the form of a square or rectangular shape, for example. The outer cap 524 includes a flat top 568 surrounded by a circumferential side wall 570. The flat top 568 is sufficiently sized to cover the circular recess 508 of the pressure vessel 502, thus inhibiting debris (e.g., dust and dirt) from interfering with the air stem 511. The circumferential side wall 570 may include one or more vertically extending ribs 572 to provide a sufficient gripping surface for a user to remove the outer cap 524 from the pressure vessel 502.

In addition, the outer cap 524 may include a hollow cavity 574 that downwardly extends from a central portion 576 of the flat top 568 inside the outer cap 524. The hollow cavity 574 may be substantially the same shape as the valve cap 520 to allow the valve cap 520 to be snap-fitted or press-fitted, for example, into the hollow cavity 574. Alternatively, the valve cap 520 may be anchored to the hollow cavity 574 by using glue or any other suitable adhesive to inhibit the valve cap 520 from rotating or separating from the outer cap 524. The hollow cavity 574 may include an inner surface 578 defined by one or more circumferential grooves 580 and one or more circumferential lips 582 that correspond with a circumferential lip 584 and a circumferential groove 586, respectively, disposed on an outer surface 588 of the valve cap 520. The valve cap 520 may have internal threads 590 on an inner surface 592 of the valve cap 520 positioned just below the washer 536, for example.

Figure 7B:
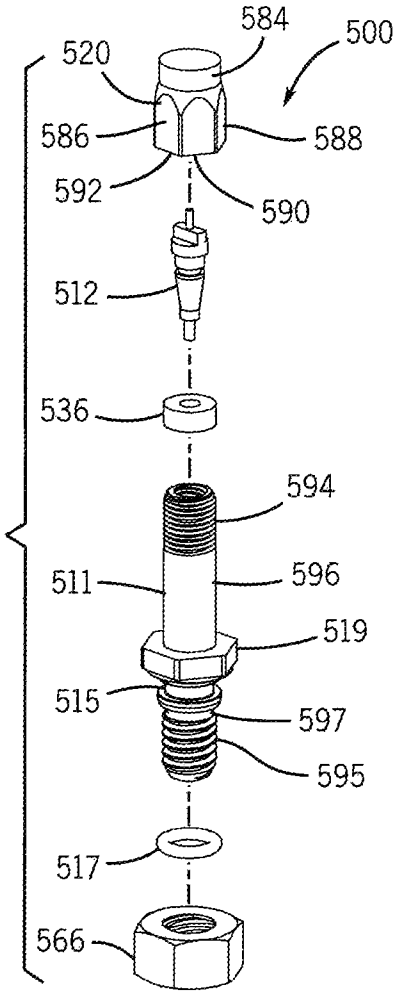
FIG. 7B is an exploded view of a portion of the cap system of FIG. 7A.
Figure 7A:
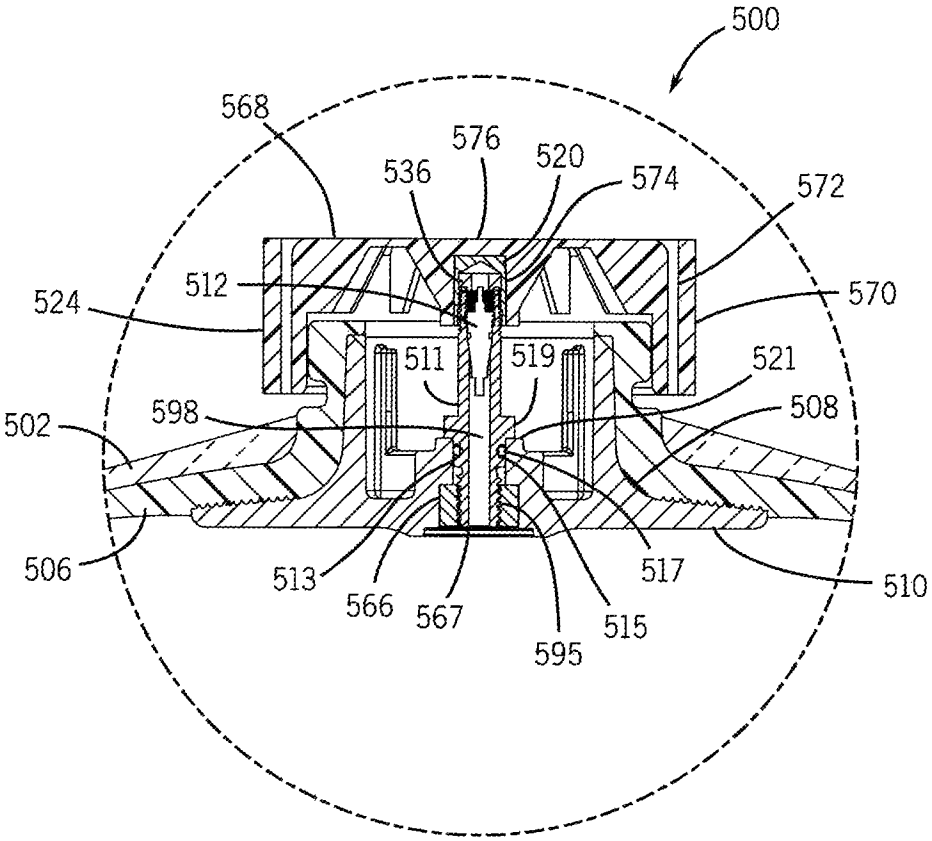
FIG. 7A is an enlarged cross-sectional view of the cap system of FIG. 7.
Figure 7D:
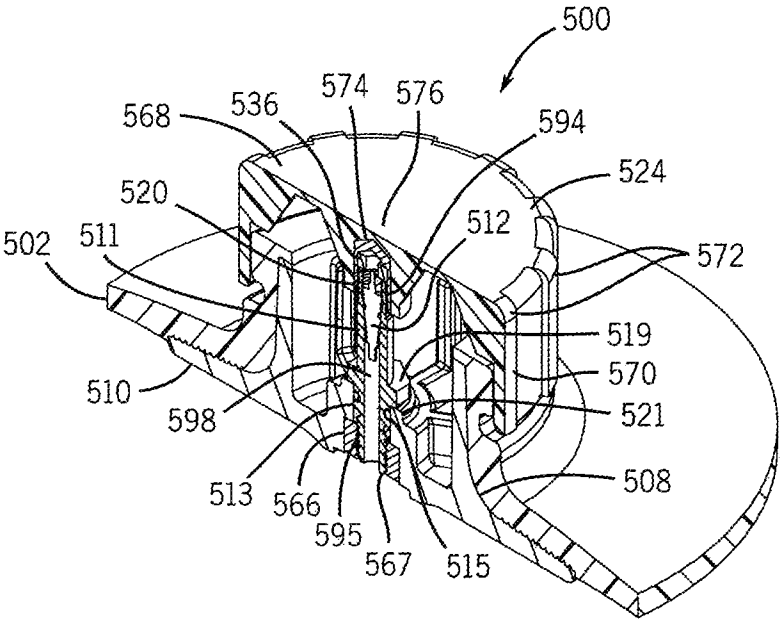
FIG. 7D is cross-sectional view of the cap system of FIG. 7C in an assembled configuration.
Figure 7C:
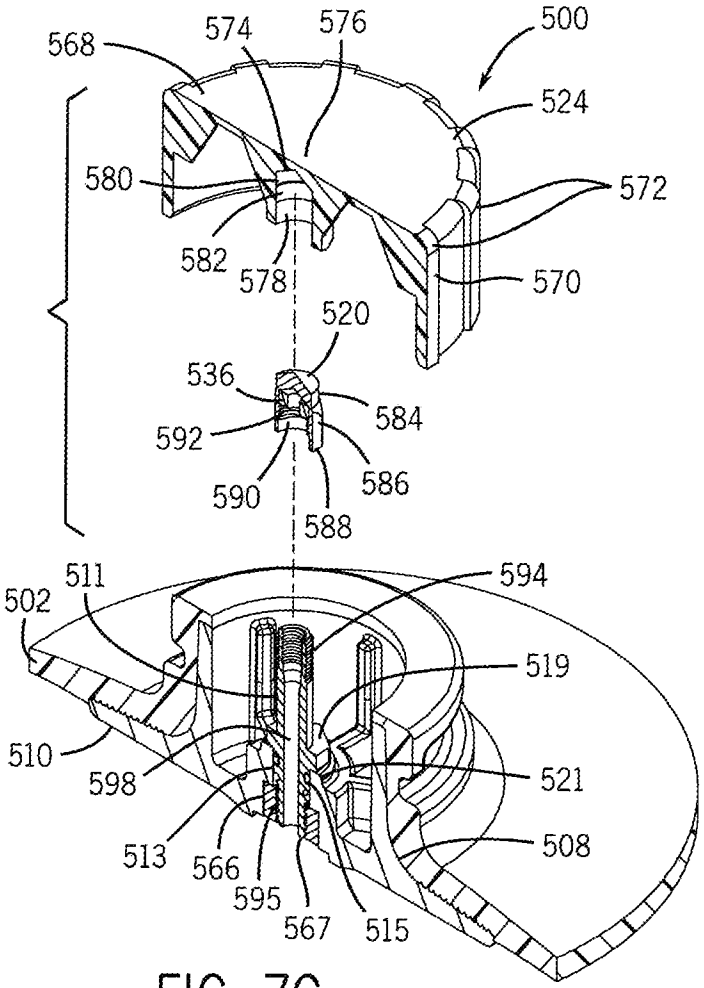
FIG. 7C is a cross-sectional exploded view of the cap system of FIG. 7A.

Once the valve cap 520 is anchored to the outer cap 524, the single cap assembly may be screwed onto the air stem 511 by engaging the internal threads 590 with external threads 594 positioned on a first end portion 596 of the air stem 511. The air stem 511 includes a hollow core 598, as shown in FIGS. 7C and 7D, to allow insertion of the valve stem 512 into the hollow core 598 at the first end portion 596 of the air stem 511, as shown in FIGS. 7A and 7B. Thus, when the valve cap 520 and outer cap 524 assembly are screwed onto the air stem 511, the valve stem 512 engages the washer 536 inside the valve cap 520 to form a seal capable of sealing the air stem 511 from slow leaks, for example, in the valve stem 512. The washer 536 may be constructed of ethylene propylene rubber (EPDM), acrylonitrile-butadiene (NBR), or fluorocarbon (FKM), for example, or any other suitable sealing material.

Prior to coupling the valve cap 520 and the outer cap 524 assembly to the air stem 511, the air stem 511 is connected to the valve guard 510. As shown in FIG. 7B, the air stem 511 may have external threads 595 positioned at a second end portion 597 that is opposite the first end portion 596 of the air stem 511. The external threads 595 are configured to engage internal threads 567 of the fastener 566, as best shown in FIGS. 7A and 7B. The fastener 566 is positioned within an axially extending aperture 513 of the valve guard 510. The aperture 513 may be configured to restrict rotation of the fastener 566 as the air stem 511 is screwed into the fastener 566. The fastener 566 may be, for example, a hex nut or any other suitable fastener having internal threads. In one embodiment, the air stem 511 also includes an annular recess 515 near the second end portion 597 that is configured to receive an o-ring 517, thereby providing a substantially water tight and substantially air tight seal between the valve guard 510 and the air stem 511.

Still referring to FIGS. 7A-7D, the air stem 511 also includes a stepped edge 519 that may be integrally coupled to the air stem 511 and surrounds the hollow core 598 between the first end portion 596 and the second end portion 597. As the air stem 511 is screwed into the fastener 566, the stepped edge 519 can engage a top surface 521 of the valve guard 510 to indicate the air stem 511 is sufficiently coupled to the valve guard 510. The stepped edge 519 may be hex shaped or square shaped, for example, to allow a user to tighten the air stem 511 using a tool, such as a wrench or a socket. The stepped edge 519 also ensures that the air stem 511 extends beyond the circular recess 508 of the pressure vessel 502, as shown in FIGS. 7A, 7C, and 7D, when fully secured to the valve guard 510. Thus, the air stem 511 and valve stem 512 are easily accessible for acquiring a pressure inside the pressure vessel 502 using a conventional air pressure gauge, for example. Once a desired air pressure is reached within the pressure vessel 502, the valve cap 520 and the outer cap 524 assembly may be attached to the pressure vessel 502 to protect the air stem 511 and valve stem 512 from damage during normal operation or during transit, for example, of the pressure vessel 502.

Figure 8A:
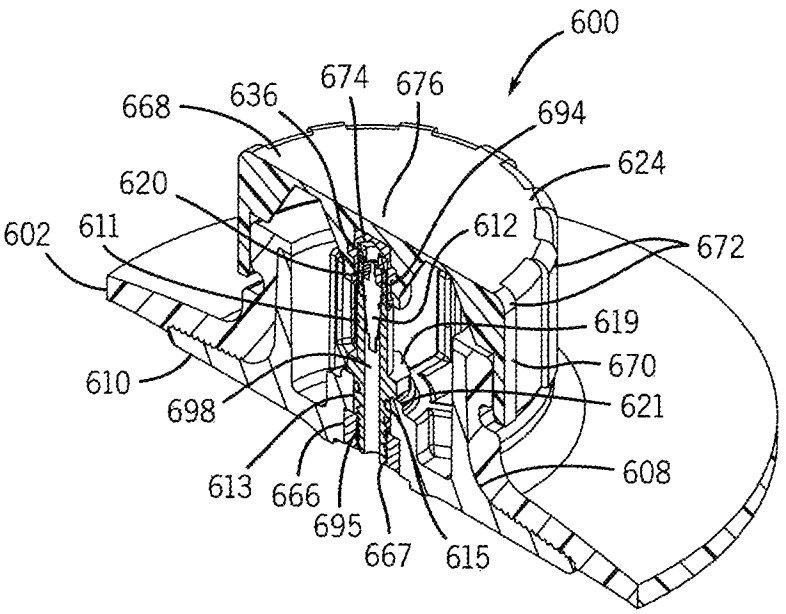
FIG. 8A is a cross-sectional view of the cap system of FIG. 8 in an assembled configuration.
Figure 8:
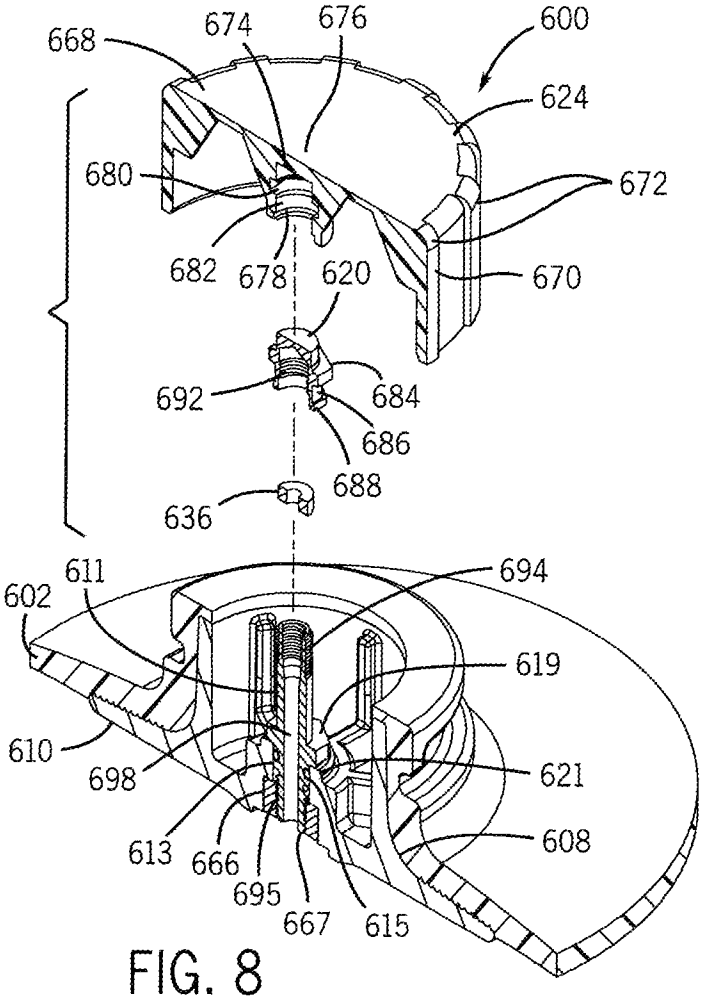
FIG. 8 is an exploded view of a portion of a cap system attached to the pressure vessel according to another embodiment of the invention.

In another embodiment shown in FIGS. 8 and 8A, a cap system 600, similar to the cap system 500 previously described, and therefore using similar reference numerals, is shown. The cap system 600 provides a sealing mechanism for the air stem 611 to inhibit potentially slow air leaks, for example, in the valve stem (not shown). In addition, the cap system 600 combines the valve cap 620 and the outer cap 624 into a one-part assembly. In general, the cap system 600, similar to the cap system 500, includes the valve cap 620 anchored to the outer cap 624. The washer 636 is positioned inside the valve cap 620 to provide the sealing mechanism and, the threaded air stem 611 engages to the valve cap 620 and the valve guard 610 by rotational threading. The valve stem is coupled to the air stem 611, and the fastener 666 couples the air stem 611 to the valve guard 610. The air stem 611 and the valve stem 612 extend above the circular recess 608 of the pressure vessel 602 to facilitate easy access to the valve stem 612 for measuring the air pressure inside the pressure vessel 602 using a conventional pressure gauge, for example.

In some embodiments, the outer cap 624 is substantially cylindrical in shape and may be formed by injection molding using a thermoplastic, such as polypropylene, for example. In an alternative embodiment, the outer cap 624 may be provided in the form of a square or rectangular shape, for example. The outer cap 624 includes the flat top 668 that is surrounded by the circumferential side wall 670. The flat top 668 is sufficiently sized to cover the circular recess 608 of the pressure vessel 602, thus inhibiting debris (e.g., dust and dirt) from interfering with the air stem 611. Similar to the cap system 500, the circumferential side wall 670 may include vertically extending ribs 672 to provide a sufficient gripping surface for a user to remove the outer cap 624 from the pressure vessel 602.

In addition, the outer cap 624 may include the hollow cavity 674 that downwardly extends from the central portion 676 of the flat top 668 inside the outer cap 624. The hollow cavity 674 may be substantially the same shape as the valve cap 620 to allow the valve cap 620 to be press-fitted, for example, into the hollow cavity 674. Alternatively, the valve cap 620 may be anchored to the hollow cavity 674 by using glue or any other suitable adhesive to inhibit the valve cap 620 from rotating or separating from the outer cap 624. The hollow cavity 674 may include the inner surface 678 defined by one or more circumferential grooves 680 and one or more circumferential lips 682 that correspond with the circumferential lip 648 and the circumferential groove 686, respectively, disposed on the outer surface 688 of the valve cap 620.

The circumferential lip 684 of the valve cap 620 may be hex-shaped, for example, to inhibit the valve cap 620 from rotating or separating from the outer cap 624. In addition, the valve cap 620 may have internal threads (not shown) on the inner surface 692 that are positioned adjacent (e.g., just below) the washer 636, for example. The valve cap 620 in the present embodiment may be constructed by over molding a brass alloy or steel plated insert nut, for example, with a thermoplastic material, such as polypropylene or high density polyethylene. Alternatively, the valve cap 620 can be injection molded followed with an interference press fit with the insert nut or valve cap 620.

The cap assembly may be screwed onto the air stem 611 in a similar manner as previously described with respect to the cap system 500, and the air stem 611 may also be connected to the valve guard 610 in a similar manner.

In an alternative embodiment, the valve cap 520, 620 may include any suitable quantity of circumferential lips 584, 684 and circumferential grooves 586, 686 to engage corresponding circumferential grooves 580, 680 and circumferential lips 582, 682 disposed on the hollow cavity 574, 674. In yet another alternative embodiment, the valve cap 520, 620 may be integrally formed with the hollow cavity 574, 674 to inhibit the valve cap 520, 620. Thus, as the outer cap 524, 624 is rotated, the integrally formed valve cap 520, 620 also rotates to engage or disengage the external threads 594, 694 of the air stem 511, 611.

Figure 9A:
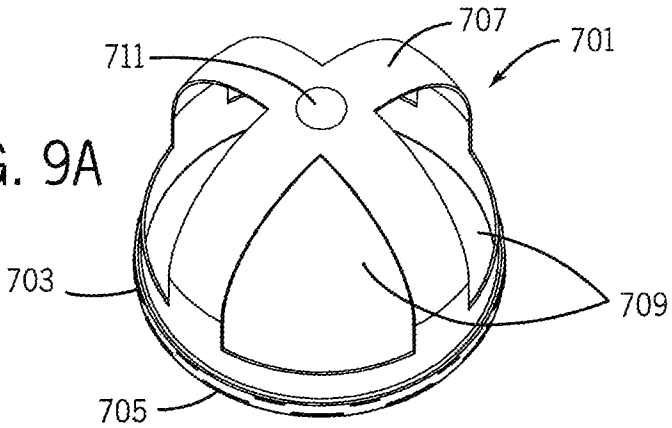
FIG. 9A is an isometric view of the diaphragm restrictor of FIG. 9 removed from the pressure vessel for clarity.
Figure 9B:
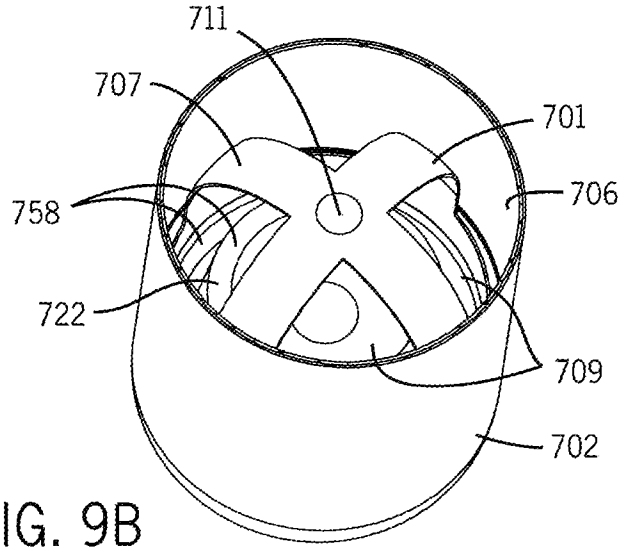
FIG. 9B is a top isometric view of the pressure vessel of FIG. 9 with a top portion removed to show the diaphragm restrictor disposed therein.
Figure 9:
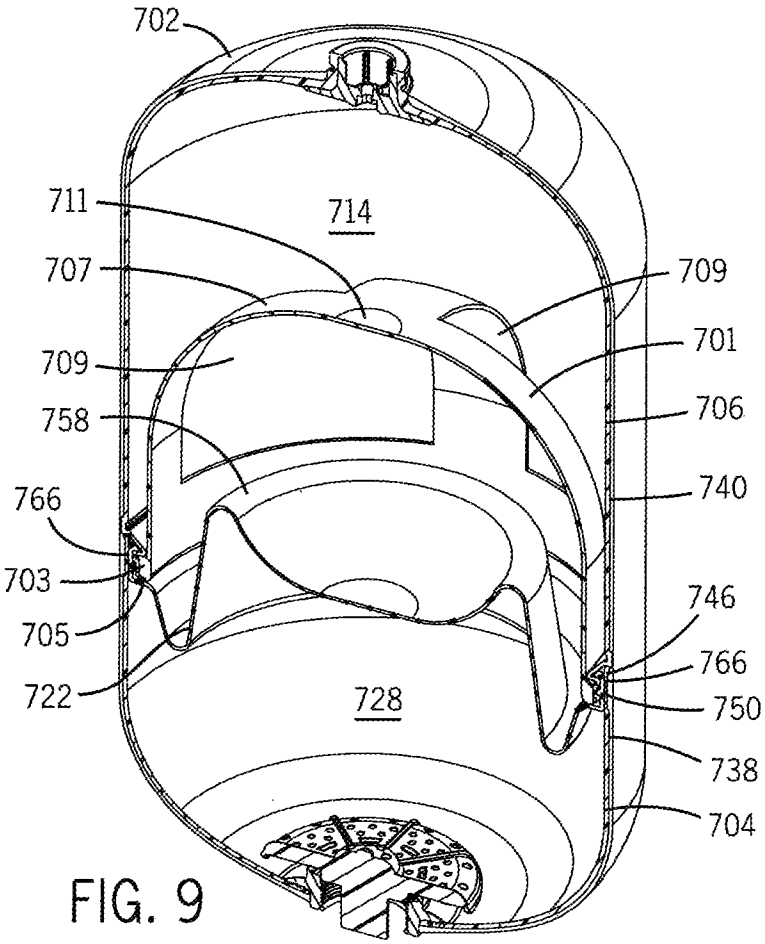
FIG. 9 is a cross-sectional view of a pressure vessel with a diaphragm restrictor attached to the pressure vessel by the joint system according to one embodiment of the invention.

Referring now to FIGS. 9, 9A, and 9B, a diaphragm restrictor system for a pressure vessel 701 is shown. The diaphragm restrictor system may be implemented into the pressure vessel 702, which may be similar to the pressure vessels 102, 302, 502, and 602, as previously described and therefore using similar reference numerals. The diaphragm restrictor system may include a restrictor 701, for example, a hydrostatic restrictor, that is configured to limit the upward movement of the diaphragm 722 within the pressure vessel 702 when the pressure vessel 702 loses pneumatic pressure and is filled with water. The loss of pneumatic pressure within the pressure vessel 702 may be the result of a faulty o-ring, a valve stem malfunction, or a worn valve cap, for example. In some embodiments, the restrictor 701 can also be functional without the convolution portion of the diaphragm 722, whereas the diaphragm joint section may only be used to seal the first tank liner 704 and the second tank liner 706.

Still referring to FIGS. 9, 9A, and 9B, a mechanical locking mechanism is provided by the diaphragm restrictor system to hold the first tank liner 704 and the second tank liner 706 together using a snap-fit mechanism. The diaphragm restrictor system includes the diaphragm 722, such as a convoluted diaphragm, that may be preformed with one or more concentric circular corrugations 758 to enable the diaphragm 722 to expand into either the water chamber 728 or the pressure chamber 714 of the pressure vessel 702. The diaphragm 722 includes an outer wall portion 766 that is configured to snap-fit between the first end portion 746 of the first circumferential side wall 738 of the first tank liner 704 and the second end portion 750 of the second circumferential side wall 740 of the second tank liner 706, as shown in FIG. 9 and described previously. The first end portion 746 may be vertically aligned with the first circumferential side wall 738 of the first tank liner 704. In contrast, the second end portion 750 may be offset from the second circumferential side wall 740 of the second tank liner 706, thereby creating a snap-fit mechanism to hold the first tank liner 704 and the second tank liner 706 together.

The restrictor 701 may have a dome shaped surface 707 and include an integrally formed circumferential support ring 703 along a bottom edge 705. The restrictor 701 is positioned between the pressure chamber 714 and the water chamber 728 so that the circumferential support ring 703 can engage the offset second end portion 750 of the second tank liner 706. The circumferential support ring 703 is sufficiently sized in diameter to provide compression on the offset second end portion 750. Thus, the circumferential support ring 703 provides compression on the outer wall portion 766 of the diaphragm 722 that is sandwiched between the first end portion 746 of the first tank liner 704 and the second end portion 750 of the second tank liner 706. As the diaphragm 722 extends into the pressure chamber 714, the restrictor 701 will inhibit the diaphragm 722 from extending past the dome shaped surface 707.

Figure 10A:
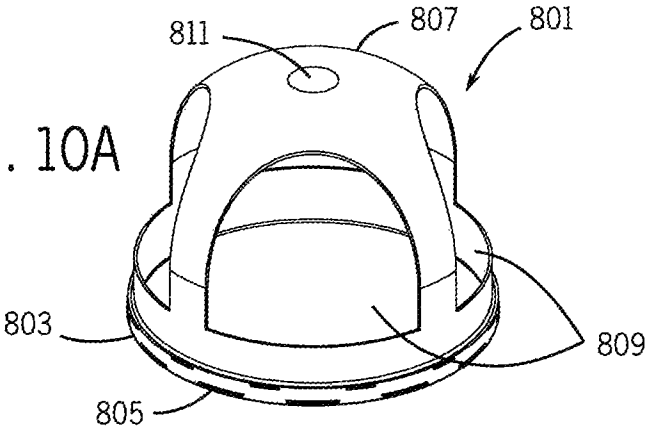
FIG. 10A is an isometric view of the diaphragm restrictor of FIG. 10 removed from the pressure vessel for clarity.
Figure 10B:
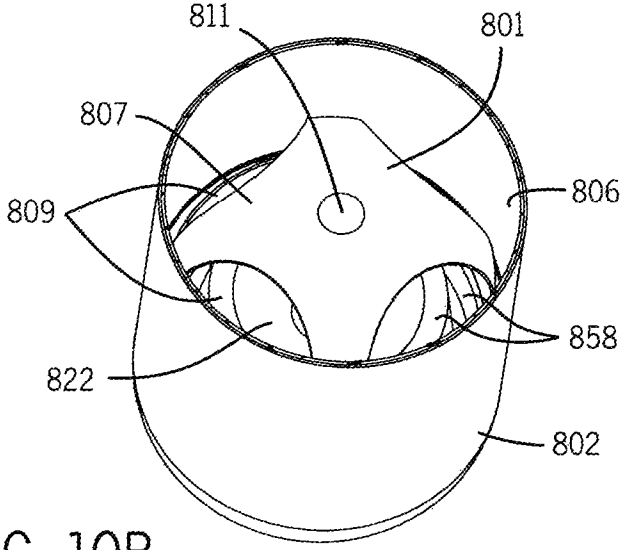
FIG. 10B is a top isometric view of the pressure vessel of FIG. 10 with a top portion removed to show the diaphragm restrictor disposed therein.
Figure 10:
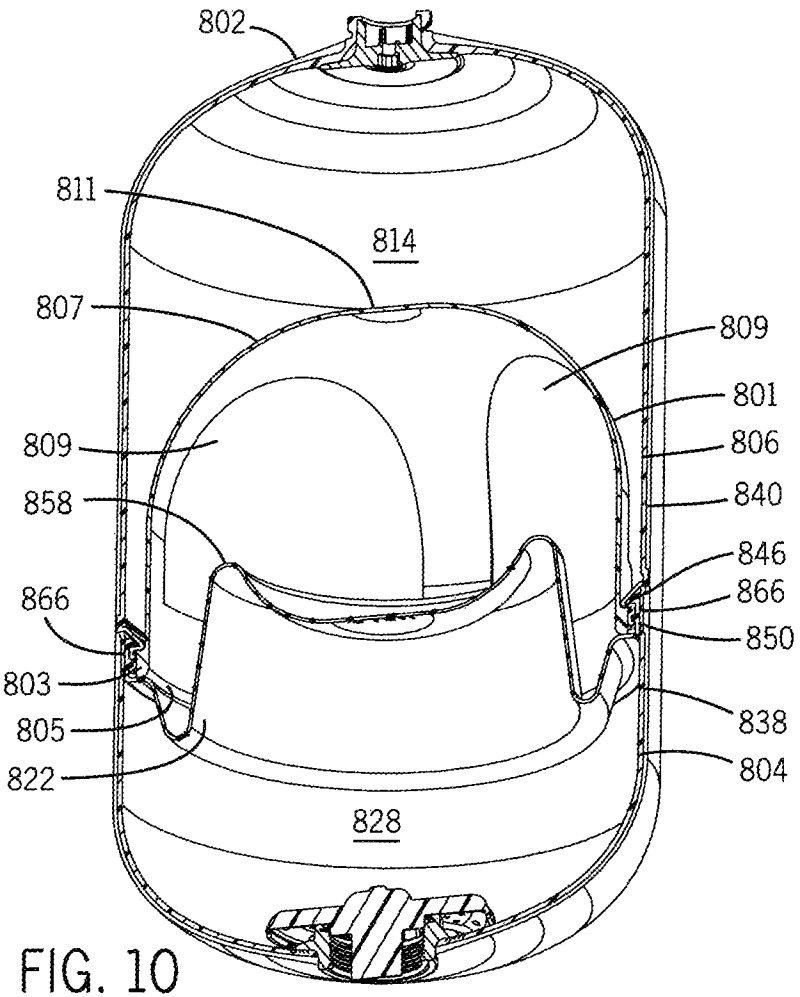
FIG. 10 is a cross-sectional view of a pressure vessel with a diaphragm restrictor attached to the pressure vessel by the joint system according to another embodiment of the invention.

The restrictor 701 may also include one or more apertures 709 spaced along the dome shaped surface 707 to allow hydraulic pressure or pneumatic pressure to pass through the restrictor 701 during normal operation of the pressure vessel 702. The one or more apertures 709 may extend from the circumferential support ring 703 to a central portion 711 of the dome shaped surface 707. The apertures 709 of the embodiment shown in FIGS. 9-9B are substantially triangular shaped, however, other shapes and configurations of apertures are contemplated. For example, as shown in FIGS. 10, 10A, and 10B, the apertures 809 are provided in the shape of a semi-circle and interrupt the dome shaped surface 807. The apertures 809 extend from the circumferential support ring 803 toward the central portion 811 of the dome shaped surface 807. The restrictor 701 may be constructed of a high strength glass filled thermoplastic material, steel, a thermoset material, and/or combinations thereof, for example.

Figure 11A:
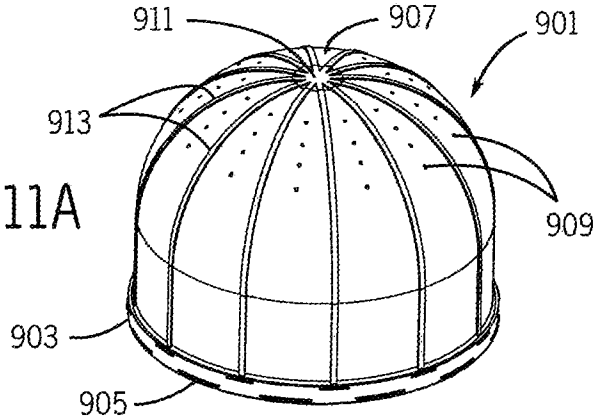
FIG. 11A is an isometric view of the diaphragm restrictor of FIG. 11 removed from the pressure vessel for clarity.
Figure 11B:
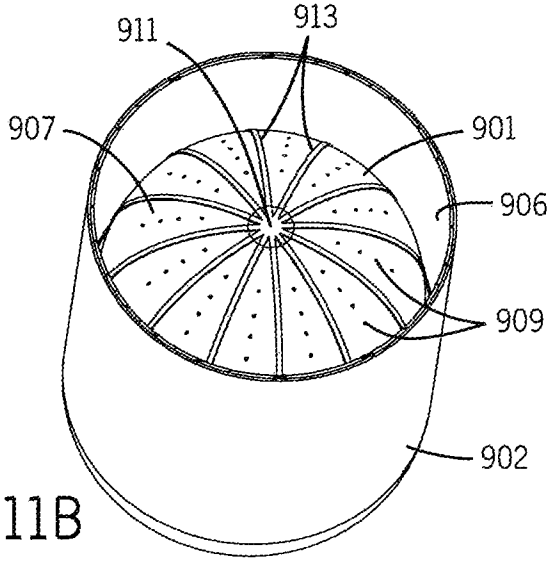
FIG. 11B is a top isometric view of the pressure vessel of FIG. 11 with a top portion removed to show the diaphragm restrictor disposed therein.
Figure 11:
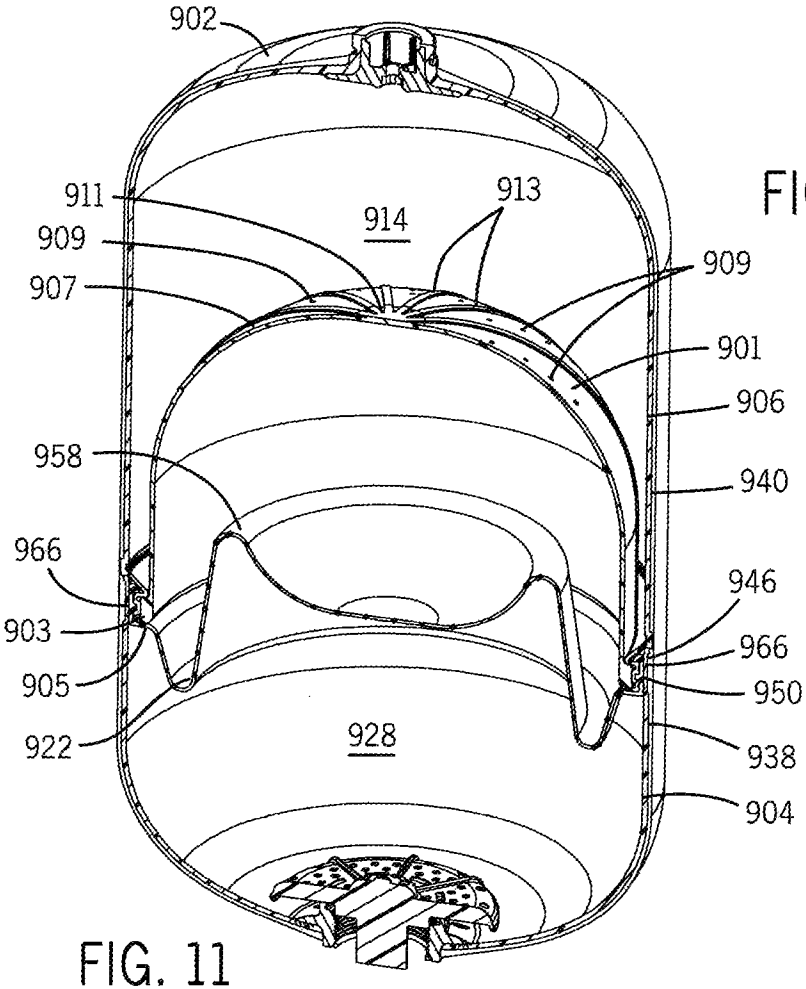
FIG. 11 is a cross-sectional view of the pressure vessel with a diaphragm restrictor attached to the pressure vessel by the joint system according to another embodiment of the invention.

In another embodiment, as shown in FIGS. 11, 11A, and 11B, the restrictor 901 includes a bowl-shaped body having a plurality of vertical ribs 913 extending from the circumferential support ring 903 to the central portion 911 of the dome shaped surface 907. Similarly, a plurality of vertically aligned apertures 909 may also extend from the circumferential support ring 903 to the central portion 911 of the dome shaped surface 907 in between each of the vertical ribs 913 to allow hydraulic pressure or pneumatic pressure to pass through the restrictor 901 during normal operation of the pressure vessel 902.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A joint system for a pressure vessel, comprising:

a first tank liner having a first circumferential side wall and a first end portion offset from the first circumferential side wall to form a first outer annular recess;

a second tank liner having a second circumferential side wall and a second end portion offset from the second circumferential side wall to form a second outer annular recess;

an H-ring having a substantially H-shaped cross-section and separating the first tank liner and the second tank liner, the H-ring including a first circumferential groove and a second circumferential groove, the first circumferential groove configured to receive the first end portion of the first tank liner and the second circumferential groove configured to receive the second end portion of the second tank liner; and fiberglass windings surrounding the first tank liner and the second tank liner in tension and configured to lock the first tank liner and the second tank liner together against the H-ring.

2. The joint system of claim 1, wherein the H-ring is configured to engage the first tank liner, the second tank liner, and the fiberglass windings.

3. The joint system of claim 1, wherein the H-ring is over-molded by a convoluted diaphragm, the convoluted diaphragm dividing the pressure vessel into a pair of chambers sealed relative to each other and positioned between the first tank liner and the second tank liner.

4. The joint system of claim 1, wherein the pressure vessel does not include an external bracket, an external brace, or other external locking mechanism, beside the fiberglass winding, designed to lock the first and second tank liners together.

5. The joint system of claim 3, wherein the first tank liner and the second tank liner are mechanically locked together by a combination of the convoluted diaphragm and H-ring.

6. The joint system of claim 3 further comprising a bottom diffuser including a screen coupled to an inlet of the pressure vessel configured to at least one of diffuse and mix water flowing into and out of the pressure vessel and drain water out of the pressure vessel to inhibit the convoluted diaphragm from at least one of sealing a drain of the pressure vessel and extruding and puncturing the convoluted diaphragm.

7. The joint system of claim 3, wherein the convoluted diaphragm is configured to provide a linear diaphragm free state height, the linear diaphragm free state height equivalent to a predetermined air pre-charge value and a predetermined water capacity height to minimize deformation and stress on the convoluted diaphragm.

8. The joint system of claim 1, wherein the H-ring provides a substantially positive water tight and air tight seal between the first tank liner and the second tank liner during cyclic and high pressure requirements.

9. The joint system of claim 1, wherein the pressure vessel is a hydropneumatic tank.

10. The joint system of claim 1, further comprising a grid plate with a baffle coupled to an inlet of the pressure vessel configured to diffuse and mix water flowing into and out of the pressure vessel.

* * * * *